US009119494B2

(12) United States Patent
Boaron et al.

(10) Patent No.: US 9,119,494 B2
(45) Date of Patent: Sep. 1, 2015

(54) APPARATUS FOR WEARING SOCKS

(71) Applicants: Reuven Boaron, Etz Efraim (IL); Tal Shahar, Rishpon (IL)

(72) Inventors: Reuven Boaron, Etz Efraim (IL); Tal Shahar, Rishpon (IL)

( * ) Notice: Subject to any disclaimer, the term of this patent is extended or adjusted under 35 U.S.C. 154(b) by 0 days.

(21) Appl. No.: 14/523,972

(22) Filed: Oct. 27, 2014

(65) Prior Publication Data

US 2015/0115001 A1 Apr. 30, 2015

Related U.S. Application Data

(60) Provisional application No. 61/897,457, filed on Oct. 30, 2013.

(51) Int. Cl.
*A47G 25/90* (2006.01)

(52) U.S. Cl.
CPC ..... *A47G 25/905* (2013.01)

(58) Field of Classification Search
CPC ... A47G 25/90; A47G 25/905; A47G 25/907; A47G 25/908
USPC ..... 223/111, 112
See application file for complete search history.

(56) References Cited

U.S. PATENT DOCUMENTS

| | | | | |
|---|---|---|---|---|
| 5,927,573 | A * | 7/1999 | Votino et al. | 223/111 |
| 6,102,262 | A * | 8/2000 | Nicholson | 223/112 |
| 7,270,253 | B2 * | 9/2007 | Radke et al. | 223/112 |
| 8,528,796 | B1 * | 9/2013 | Bosko et al. | 223/112 |
| 2006/0027612 | A1 * | 2/2006 | Boaron | 223/111 |
| 2009/0120975 | A1 * | 5/2009 | Schoepe | 223/111 |

FOREIGN PATENT DOCUMENTS

DE 102004001905 A1 * 10/2005 ..... A47G 25/90

* cited by examiner

*Primary Examiner* — Nathan Durham
(74) *Attorney, Agent, or Firm* — Eitan, Mehulal & Sadot

(57) ABSTRACT

Apparatus for donning or wearing socks, and method of using such apparatus. The apparatus includes: a substantially horizontal base; an elongated U-shaped, semi-cylindrical caddy on which a sock positioned inside out is fittable and into an interior of which a foot is insertable; and a tilt unit coupled to the caddy and pivotally connected to a head portion of the base. The base is T-shaped and is configurable by an elongated main portion and two spaced, forwardly positioned head portions. The tilt unit is insertable within an interspace between the two head portions. The tilt unit is pivotally connected to the two head portions by at least one coupled horizontally disposed pin which is substantially perpendicular to the main portion. The tilt unit and the caddy are able to be tilted about a horizontal axis during a sock donning operation.

7 Claims, 36 Drawing Sheets

APPARATUS FOR WEARING SOCKS

CROSS-REFERENCE TO RELATED APPLICATIONS

This application claims priority and benefit from U.S. provisional patent application No. 61/897,457, titled "Apparatus for Wearing Socks", filed on Oct. 30, 2013, which is hereby incorporated by reference in its entirety.

FIELD

The present invention relates to the field of socks, as well as aids for daily living and aids for wearing socks.

BACKGROUND

Millions of people wear socks every day. A sock is an item of clothing worn on the foot. In hot climate or hot environment, socks may absorb sweat and perspiration from the feet. In cold climate or cold environment, socks may provide comfort and heating to the feet, and may decrease the risk of frostbite. Socks are often worn as an intermediary layer between the bare feet and a pair of shoes, thereby providing additional comfort to the wearer.

Socks may be manufactured from various materials, for example, cotton, wool, nylon, acrylic, polyester, spandex, silk, and/or other material(s). Socks may be manufactured in different sizes or lengths, for example, ankle socks, knee-high socks, over-the-knee socks, or the like.

SUMMARY

The present invention may include, for example, devices for wearing socks, or devices which may assist a person to put-on or to wear or to don a sock; as well as methods of utilizing or operating such devices.

In some embodiments of the present invention, for example, an apparatus for donning (or wearing) a sock may comprise: a substantially horizontal base; an elongated U-shaped, semi-cylindrical caddy on which a sock positioned inside out is fittable and into an interior of which a foot is insertable; and a tilt unit coupled to said caddy and pivotally connected to a head portion of said base.

In some embodiments, the base is T-shaped and is configurable by an elongated main portion and two spaced, forwardly positioned head portions. The tilt unit is insertable within an interspace between said two head portions. The tilt unit is pivotally connected to said two head portions by at least one coupled horizontally disposed pin which is substantially perpendicular to said main portion. The pin is introducible within a recess formed within a forwardly positioned projection of the tilt unit. The tilt unit and the caddy are able to be tilted about a horizontal axis during a sock donning operation.

The present invention may provide other and/or additional benefits and/or advantages.

BRIEF DESCRIPTION OF THE DRAWINGS

For simplicity and clarity of illustration, elements shown in the figures have not necessarily been drawn to scale. For example, the dimensions of some of the elements may be exaggerated relative to other elements for clarity of presentation. Furthermore, reference numerals may be repeated among the figures to indicate corresponding or analogous elements. The figures are listed below.

DETAILED DESCRIPTION OF SOME EMBODIMENTS

Figure 1:
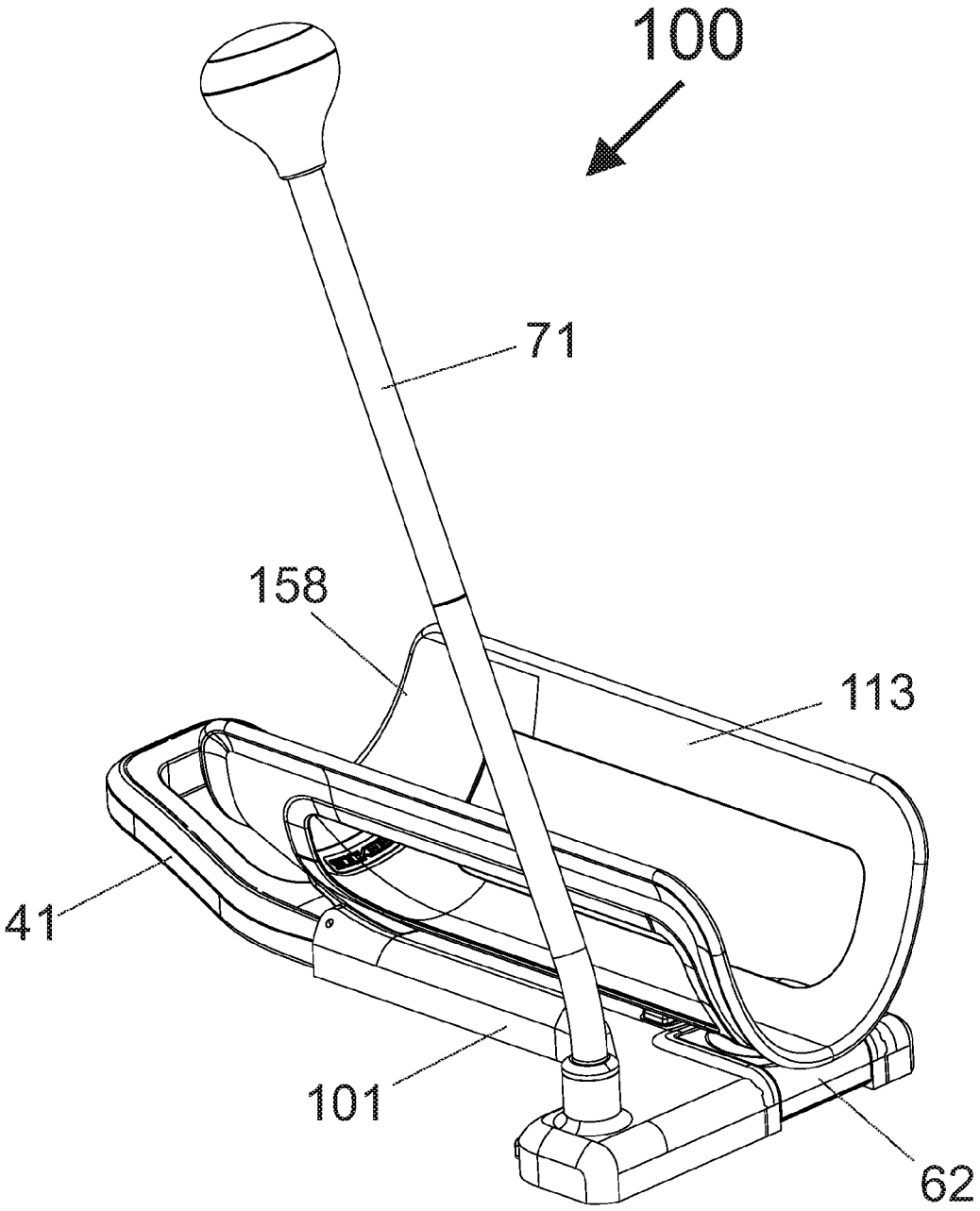
FIG. 1 is a perspective view from the side of sock donning apparatus in a rest position, in accordance with some demonstrative embodiments of the present invention.

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or circuits have not been described in detail so as not to obscure the discussion.

The term "sock" as used herein may include any suitable type of sock or foot apparel, or any type of garment or article-of-clothing which is intended for wearing on the foot.

Applicants have realized that some people may have difficulty in wearing (or donning) socks by themselves. Such persons may include, for example, disabled persons, handicapped or invalid persons, persons that suffer from a particular disease or medical condition, children, senior citizens, old persons, persons that are tired or exhausted, persons that have difficulty bending down and/or reaching their toes and/or reaching their feet and/or reaching their ankles, or the like. Furthermore, other types of users, who may not suffer from any limiting condition, may still benefit from a device which may assist user to put-on socks, and which may obviate the need to bend-down or to reach-down in order to put on the socks.

The present invention relates to the field of invalid aids and appliances. More particularly, the invention relates to an apparatus and method for self-serve use by invalids or handicapped persons, and especially for use by invalids with amputated or disabled arms, or by people having muscular dystrophy or tendon problems, permitting a person to don his sock without any assistance.

Applicants have realized that people with various physically limiting conditions may have difficulty in dressing themselves unassisted by a second individual, limiting their ability to live independently; this at times contributes to lowered self-esteem and depression. Examples of limiting physical conditions that may contribute to such difficulties while properly and comfortably getting dressed may include: pregnancy, obesity, and a diminished range of motion in the back, hip, knee, ankle, or foot; often caused by injury, disease, or surgery. Applicants have realized that one special problem for invalids, handicapped persons with amputated or disabled arms, people having muscular dystrophy or tendon problems, or people who are recovering from a surgery, is the donning of socks.

Applicants have realized that some prior attempts to provide a sock donning device, have resulted in complicated devices that are unusable for an invalid or a handicapped person with amputated or disabled arms, or for persons having muscular dystrophy or tendon problems. Additionally or alternatively, such prior attempts have resulted in devices that do not operate well, or which still require utilization of two hands, or which require an assistance from another person, or which cause the sock to slip or to fall, or which suffer from various other complexities and/or deficiencies.

Applicants have realized that there is a need for an apparatus which will aid in donning socks or any other articles of hosiery, and which does not require the user to bend down, or pull, or receive assistance from another person, or the use of hands. Until now, none of the prior art devices provided a complete solution to the problem of the donning of socks or any other article of hosiery, without any assistance of another, for invalids or handicapped persons with amputated or disabled arms, or for persons having muscular dystrophy or tendon problems, or for persons with any other limiting physical condition.

The present invention seeks to overcome these difficulties by providing a sock donning apparatus which is easy to use and simple in maintenance.

Some embodiments of the present invention may provide a novel sock donning apparatus and method having many advantages while simultaneously overcoming disadvantages that prior art devices suffer from.

Some embodiments of the present invention may provide donning apparatus which is of a durable and reliable construction.

Some embodiments of the present invention may provide a sock donning apparatus which does not require a pulling motion by the user's arm, and/or does not require the user to bend his back or to bend his body, or which require the user to only slightly bend his back and/or his body.

Some embodiments of the present invention may provide a sock donning apparatus that aids a user who is an invalid, a handicapped person with amputated or disabled arms, a person having muscular dystrophy or tendon problems, a user that is recovering from surgery, or a person with any other limiting physical condition, in putting on socks within a minimal time, without requiring assistance from other person(s), and/or without bending down, and/or without bending his (or her) back, and/or without the need to reach down with the wearer's hand(s) to the wearer's toes or ankles or feet, and/or with reduced or minimal strain on the wearer's body.

Some embodiments of the present invention may provide a sock donning apparatus which utilizes the elasticity of socks to provide an easy fit for legs (or feet) of different sizes.

Some embodiments of the present invention may provide a sock donning apparatus which is compatible with socks of different sizes and types.

Some embodiments of the present invention may provide a sock donning apparatus which may be easily and efficiently manufactured and/or marketed and/or maintained and/or utilized.

Some embodiments of the present invention may provide a sock donning apparatus which may have a low cost of manufacture with regard to both materials and labor, and which accordingly may have a low cost or reduced cost for consumers.

These and further features of the present invention will be more readily appreciated when considering the following disclosure and appended drawings. Other objects and advantages of the invention will become apparent as the description proceeds.

The present invention provides apparatus for donning or wearing or putting-on socks (or a single sock; or a single garment typically worn on a foot), comprising a substantially horizontal base, an elongated U-shaped, semi-cylindrical caddy on which a sock positioned inside out is fittable and into an interior of which a foot is insertable, and a tilt unit coupled to said caddy and pivotally connected to a head portion of said base.

The sock is kept open prior to a sock donning operation to facilitate insertion of a foot into the sock. The pivotally connected tilt unit advantageously supports a pushing motion of the leg and/or of the foot, and does not require a pulling motion of an arm of the user, as has been practiced heretofore in some prior art devices.

In some embodiments, the base may be T-shaped so as to be configured by an elongated main portion and two spaced, forwardly positioned head portions, the tilt unit being insertable within an interspace between said two head portions and pivotally connected to said two head portions by at least one coupled horizontally disposed pin which is substantially perpendicular to said main portion and introducible within a recess formed within a forwardly positioned projection of the tilt unit, allowing the tilt unit and caddy to be tilted about a horizontal axis during a sock donning operation.

In some embodiments, the tilt unit may have a central through-hole through which a part protruding from the caddy and connected with a projection of a flange passes, said through-hole being positioned rearwardly from the projection of the tilt unit, allowing the caddy and flange to be rotated in unison about a vertical axis during the sock donning operation.

The flange may limit the rotational displacement of the caddy about a central axis of the through-hole. An inner face of each of the two head portions may have an upper, substantially straight and unreccesed region, and a lower region which is angularly recessed with respect to said upper region, thereby allowing the flange to rotate for a predetermined angular distance when the caddy is at a rest position until the flange contacts said inner face, yet preventing the flange from rotating when the caddy is tilted.

The apparatus may further comprise a hook member which is engageable with a stationary or relatively stationary element for providing a reactive force during the sock donning operation.

In some embodiments, the main portion of the base may be hollowed to fixedly receive the hook member, and the hook member may be selectively extendable with respect to the main portion of the base.

In some embodiments, the hook member may comprise an elongated positioning bar formed with a plurality of longitudinally spaced latching grooves, a hook rearwardly extending from said positioning bar, and a spring biased detent pivotally connected to the main portion of the base for selectively engaging one of said grooves. The detent may comprise a finger contactable portion for disengaging the detent from the engaged groove, to allow the bar to be repositioned.

The apparatus may further comprise a pole assembly extending upwardly from one of the head portions, for facilitating manual displacement of the apparatus.

In some embodiments, the pole assembly may comprise a straight pole section and a bent pole section that is movable within a cup attachment fixed to the base, for facilitating apparatus repositioning.

The present invention further includes a method for donning socks, comprising the steps of, for example: providing an apparatus comprising a substantially horizontal base and an elongated U-shaped, semi-cylindrical caddy movably coupled to said base; fitting a sock in an inside out arrangement over a rearward terminal edge of said caddy; securing said base to a relatively stationary element for providing a reactive force during a sock donning operation while a user is positioned to the rear of said caddy; inserting a foot of the user into the interior of the sock, while said foot applies a moment to said caddy to cause said caddy to pivot and an open end of the sock is gradually slipped off said rearward terminal edge of said caddy; and fully inserting toes of the user into a toe portion of the sock, to cause said caddy to assume a final pivoted position and the sock to be released from said caddy.

In some embodiments, the caddy also may rotate about a substantially vertical axis while the foot is being inserted into the interior of the sock.

In some embodiments, a first apparatus and a second (generally similar or generally identical) apparatus may be positioned forwardly to right and left feet, respectively, and first and second socks are donned on the right and left feet, respectively, thereby, allowing the first and second socks to be donned simultaneously, or concurrently, or in a serial manner (e.g., one after the other), by the same wearer.

In some embodiments, the method may further comprise the steps of: providing a hook member coupled to the base, and affixing said hook member to the relatively stationary element. The hook member may be extendable, and the length of the hook member may be set prior to inserting the foot into the interior of the sock.

In some embodiments, a pole assembly extending upwardly from the base may be manipulated or utilized by the user in order to adjust a direction of the caddy relative to a direction of the foot to be inserted into the interior of the sock.

In some embodiments, the pole assembly may comprise a straight pole section, a hand graspable knob fitted from above to said straight pole section, and a bent pole section fitted from below to said straight pole section that is rotatable within a cup attachment fixed to the base, and wherein the user selectively rotates said bent pole section when desired to bring said knob closer or farther away from the relatively stationary element in order to facilitate apparatus repositioning.

FIG. 1 illustrates a perspective view of sock donning apparatus 100 from the side, according to some demonstrative embodiments of the present invention. Apparatus 100 may comprise a base 101 and an elongated U-shaped (or concave, or convex), semi-cylindrical tube or caddy 113, for foot and/or leg placement (e.g., able to fit or to accommodate therein a human foot) that may be pivotally connected by a tilt unit 62 to base 101. A sock intended to be worn by the user is positionable on rounded rearward terminal edge 158 of caddy 113. Caddy 113 is shown in a rest position or starting position or initial position.

Base 101 may be substantially T-shaped or may be generally T-shaped, and its main portion may be hollowed to receive a slidable hook member 41, shown in a retracted position. Extending upwardly from the head or front of base 101 is a pole assembly 71, which may be used to manually displace apparatus 100 to a position that is more convenient to a user during a sock donning (sock wearing, sock putting-on) operation.

Figure 2A:
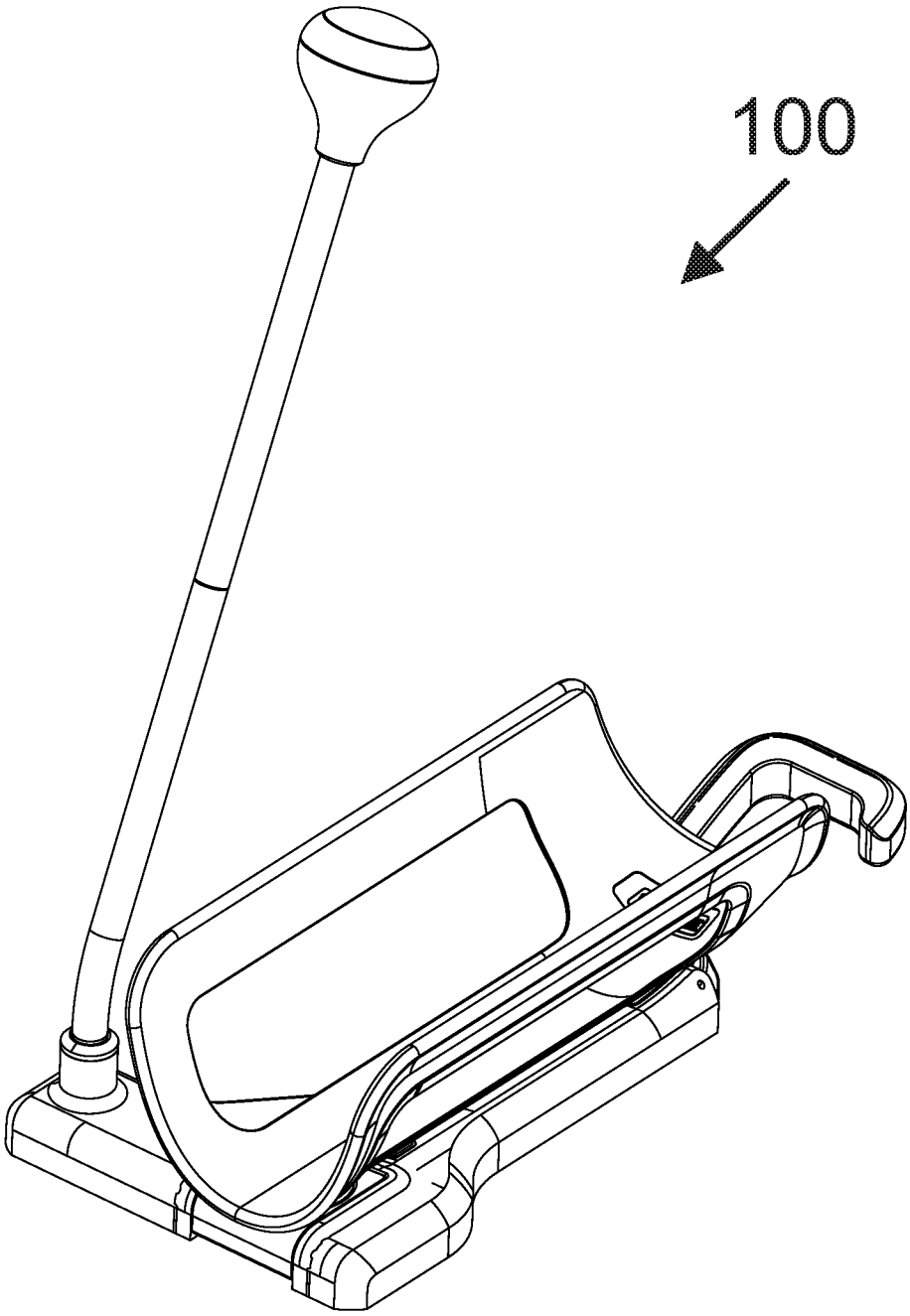
FIGS. 2A and 2B are two perspective views of the sock donning apparatus, in the rest position, in accordance with some demonstrative embodiments of the present invention.
Figure 2B:
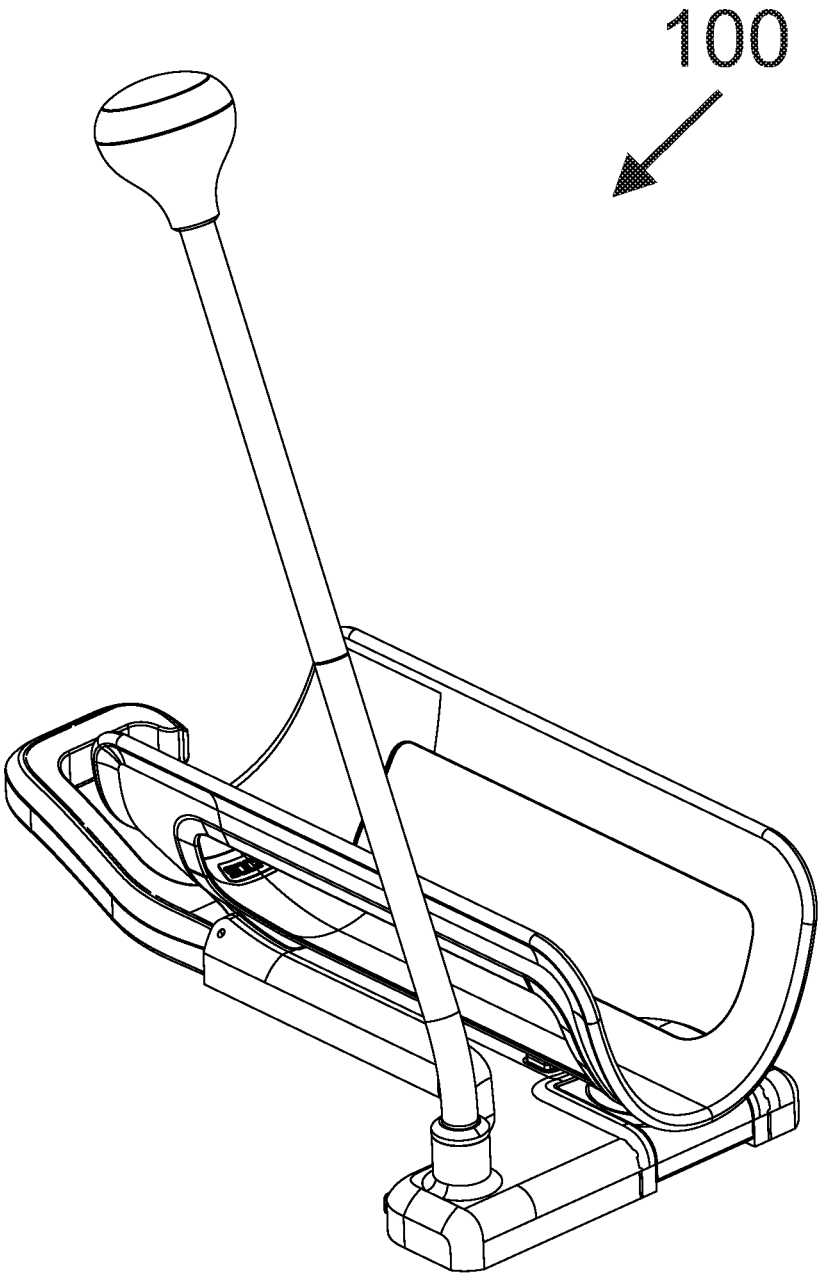
Figure 3:
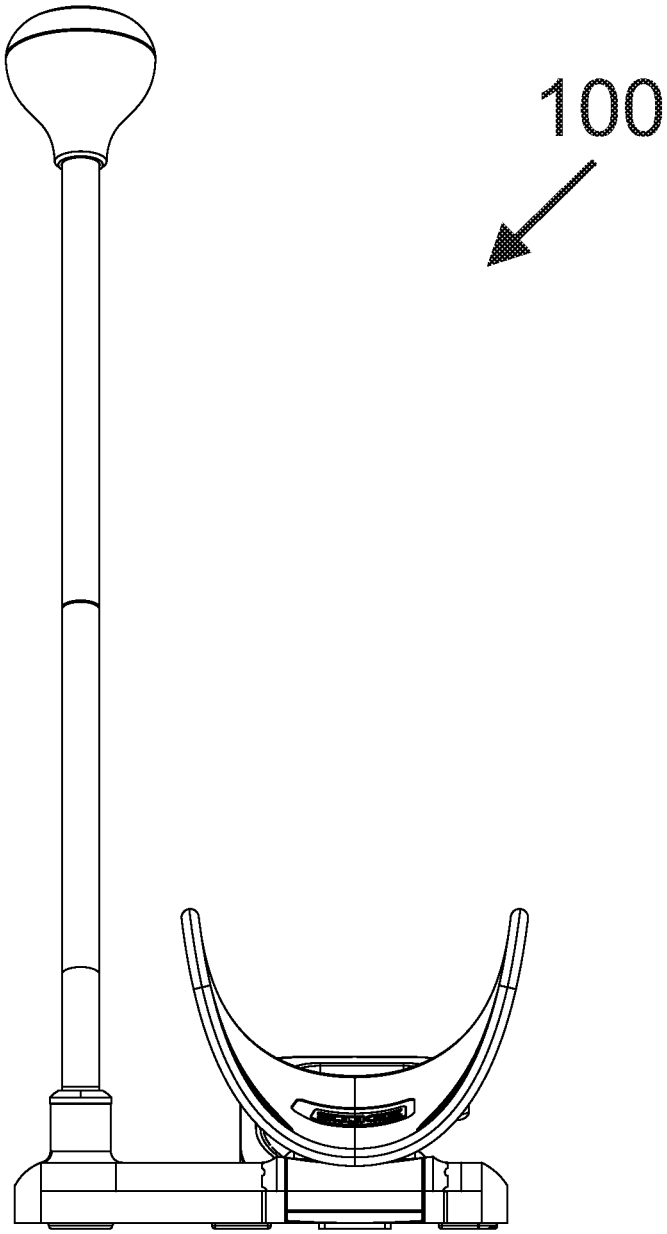
FIG. 3 is a front view of the sock donning apparatus in the rest position, in accordance with some demonstrative embodiments of the present invention.
Figure 4:
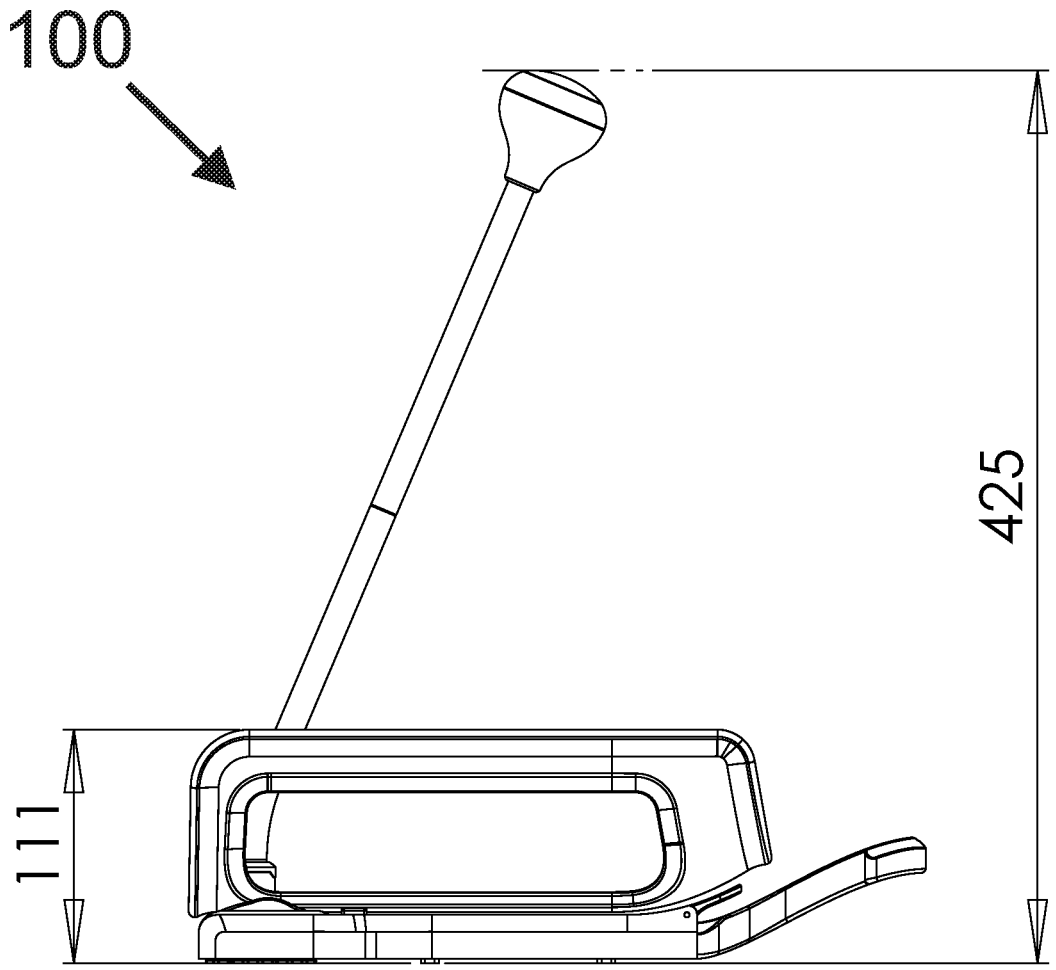
FIG. 4 is a side view of the sock donning apparatus in the rest position, in accordance with some demonstrative embodiments of the present invention.
Figure 5:
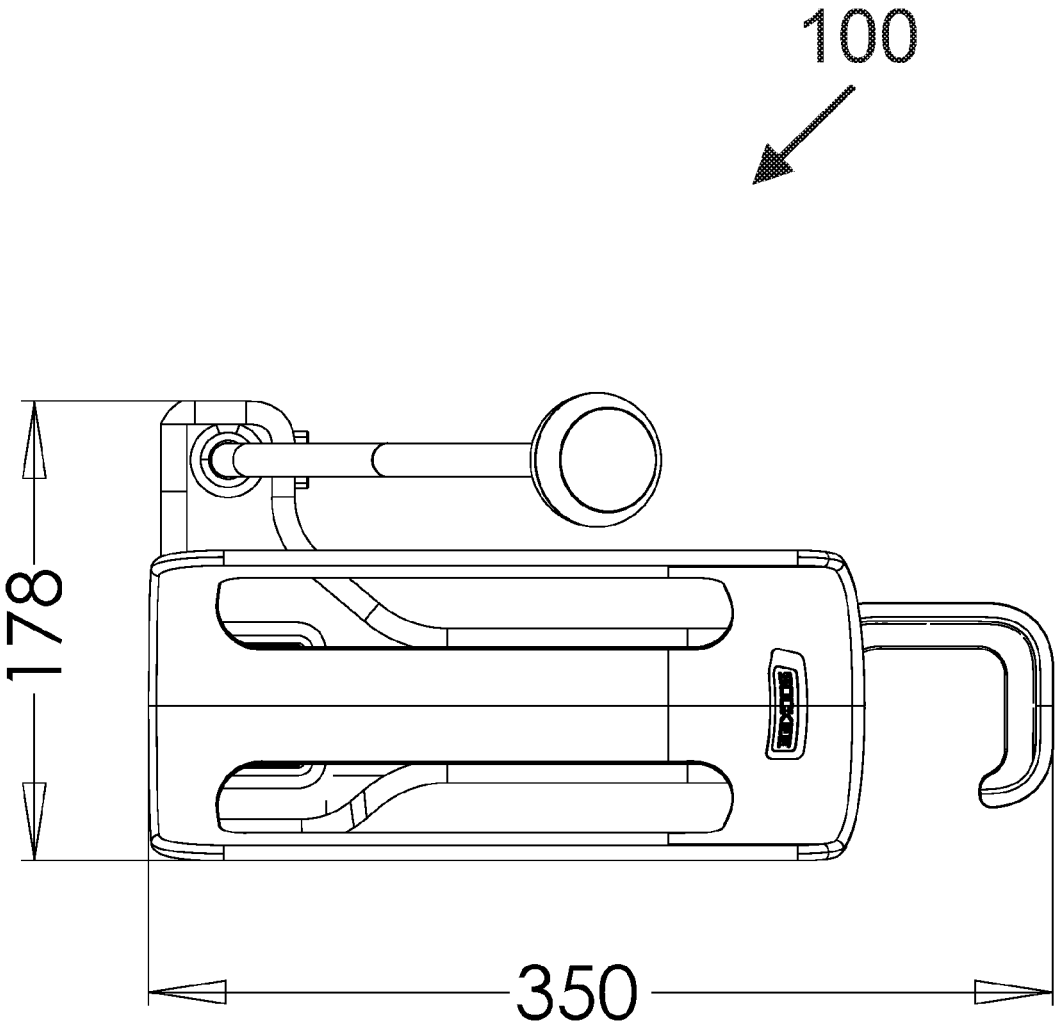
FIG. 5 is a top view of the sock donning apparatus in the rest position, in accordance with some demonstrative embodiments of the present invention.
Figure 6A:
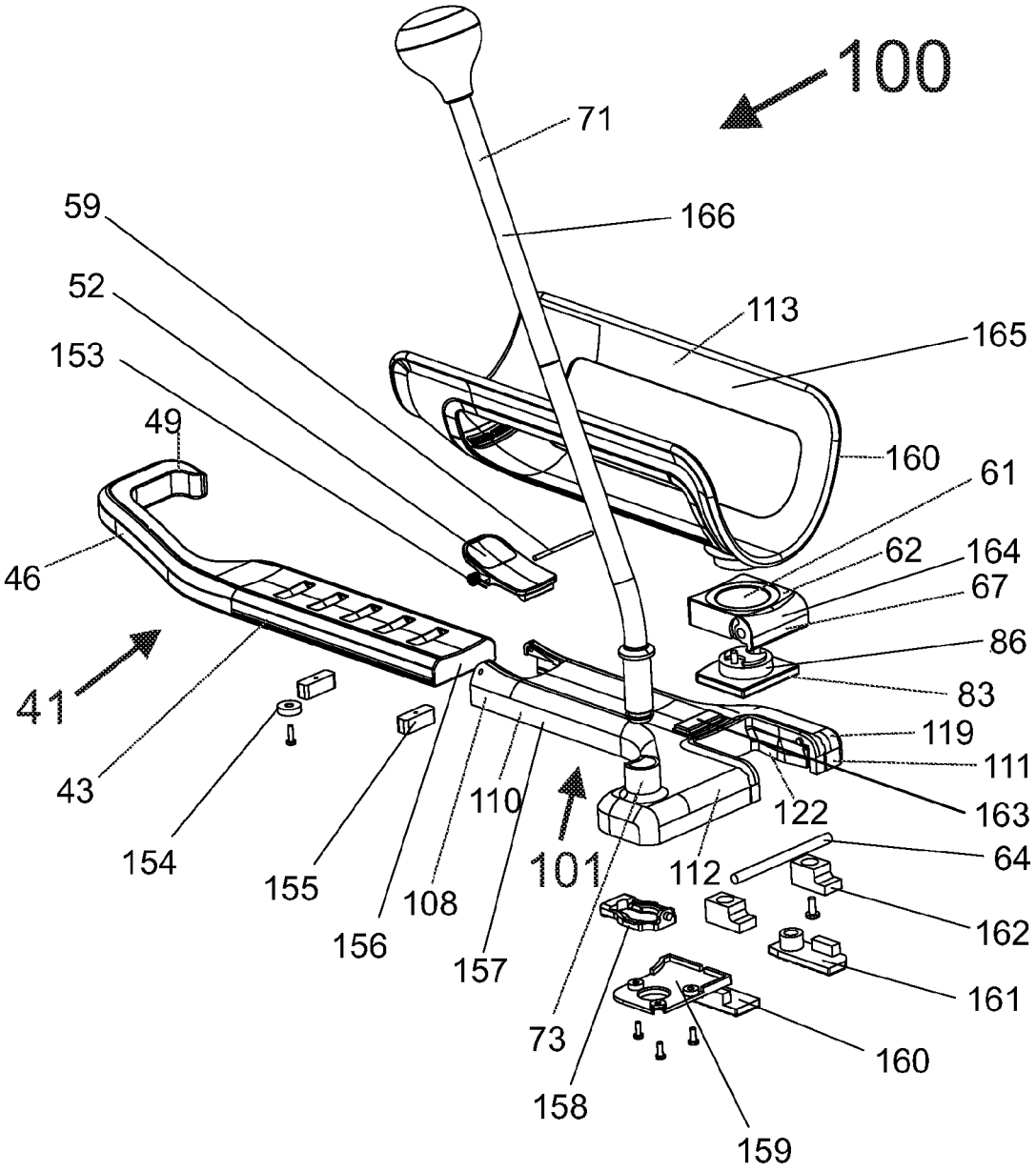
FIGS. 6A and 6B are exploded views of the sock donning apparatus in the rest position, in accordance with some demonstrative embodiments of the present invention.
Figure 6B:
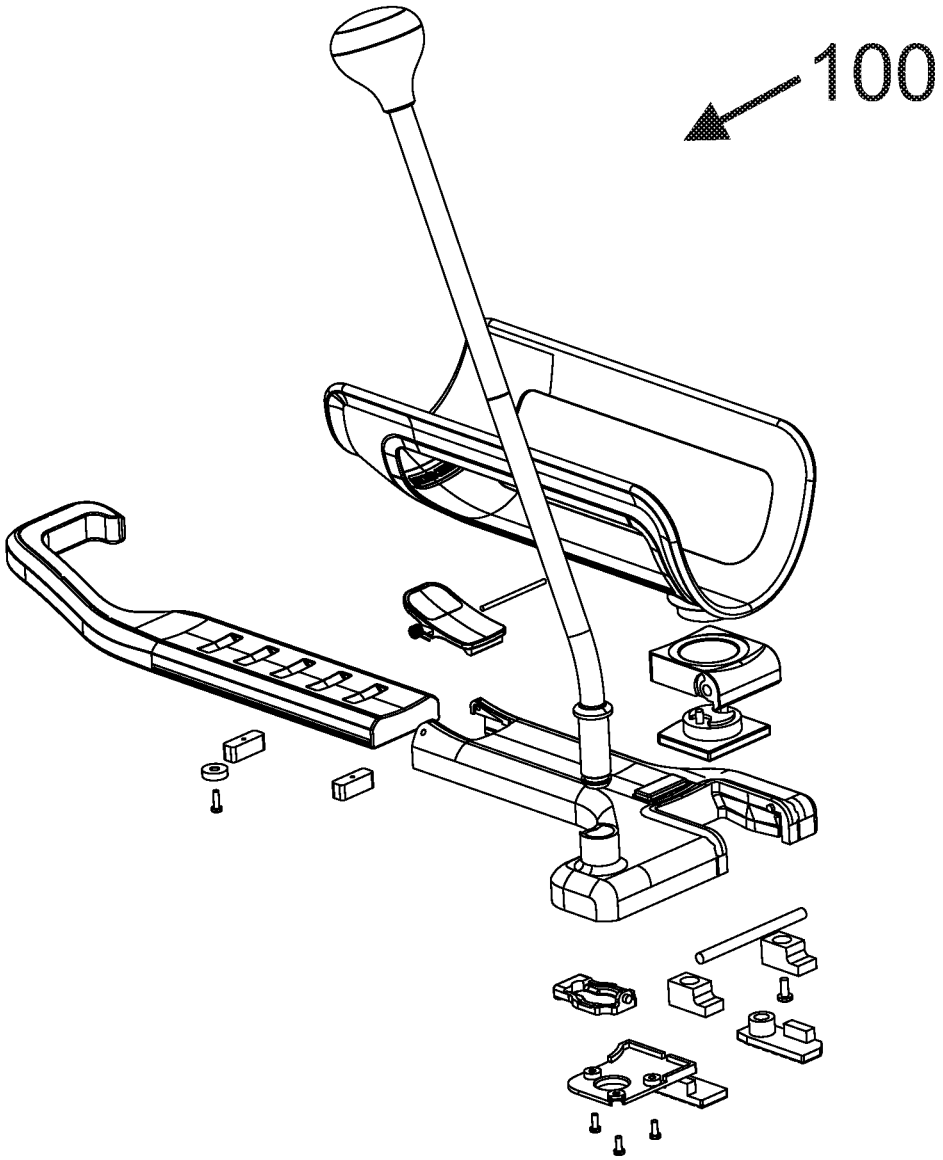

At this caddy rest position, apparatus 100 is shown in perspective views in FIGS. 2A-2B, in a front view in FIG. 3, in a side view in FIG. 4, in a top view in FIG. 5, and in exploded views in FIGS. 6A-6B.

With reference to FIGS. 6-9, a spring biased detent 52 for selectively engaging hook member 41 in order to set a desired degree of extension from base 101 may be pivotally connected by pin 59 to seats 106 formed in a corresponding protrusion 108 to main portion 110 of base 101.

Hook member 41 may comprise an elongated positioning bar 43 which may be formed, for example, with a plurality of longitudinally spaced latching grooves 45, and an inclined element 46 considerably thinner than, and extending slightly upwardly from, the longitudinal end of bar 43. Inclined element 46 may be able to change direction to define hook 49, which may be engageable with the leg of a chair or other furniture or any other stationary or relatively stationary element that can provide a reactive force (or counter-force) during a sock donning operation, as described herein.

Detent 52 may have a first rearwardly oriented portion 53 for contacting the upper surface of bar 43 and a second, finger contactable portion 54 extending rearwardly and obliquely from first portion 53. A protuberance 57 for engaging a selected groove 45 may extend downwardly from first portion 53, generally at the forward end thereof.

Second portion 54 may be normally spaced from inclined element 46 of hook element 41. Second portion 54 may be lowered when a finger applies a force thereto, causing protuberance 57 to be disengaged from groove 45 and allowing bar 43 to be displaced to a different longitudinal position with respect to main portion 110 of base 101. When the force is released, detent 52 returns to its original position and once again hook member 41 is fixed to a selected longitudinal position.

Figure 7:
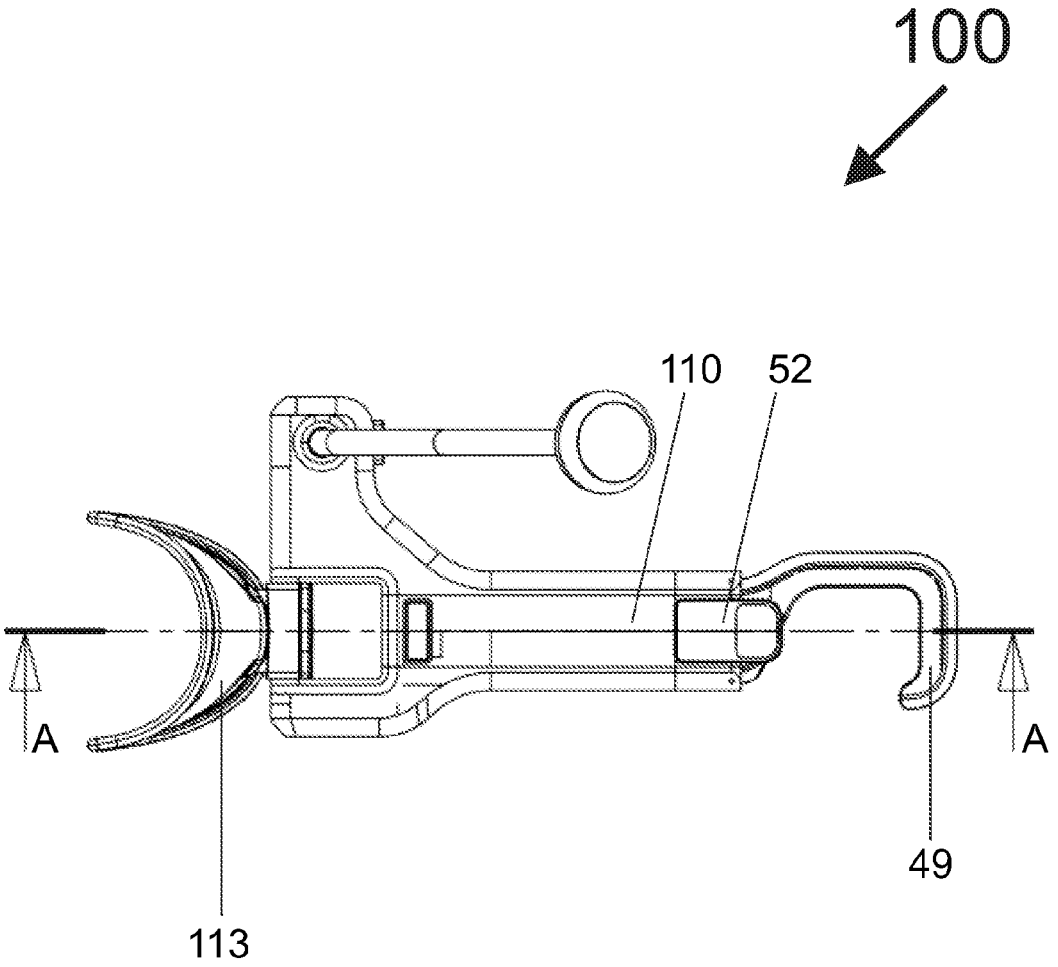
FIG. 7 is a partial top view of the sock donning apparatus, when the caddy is in a fully tilted position and the hook member is in a fully retracted position, in accordance with some demonstrative embodiments of the present invention.
Figure 8:
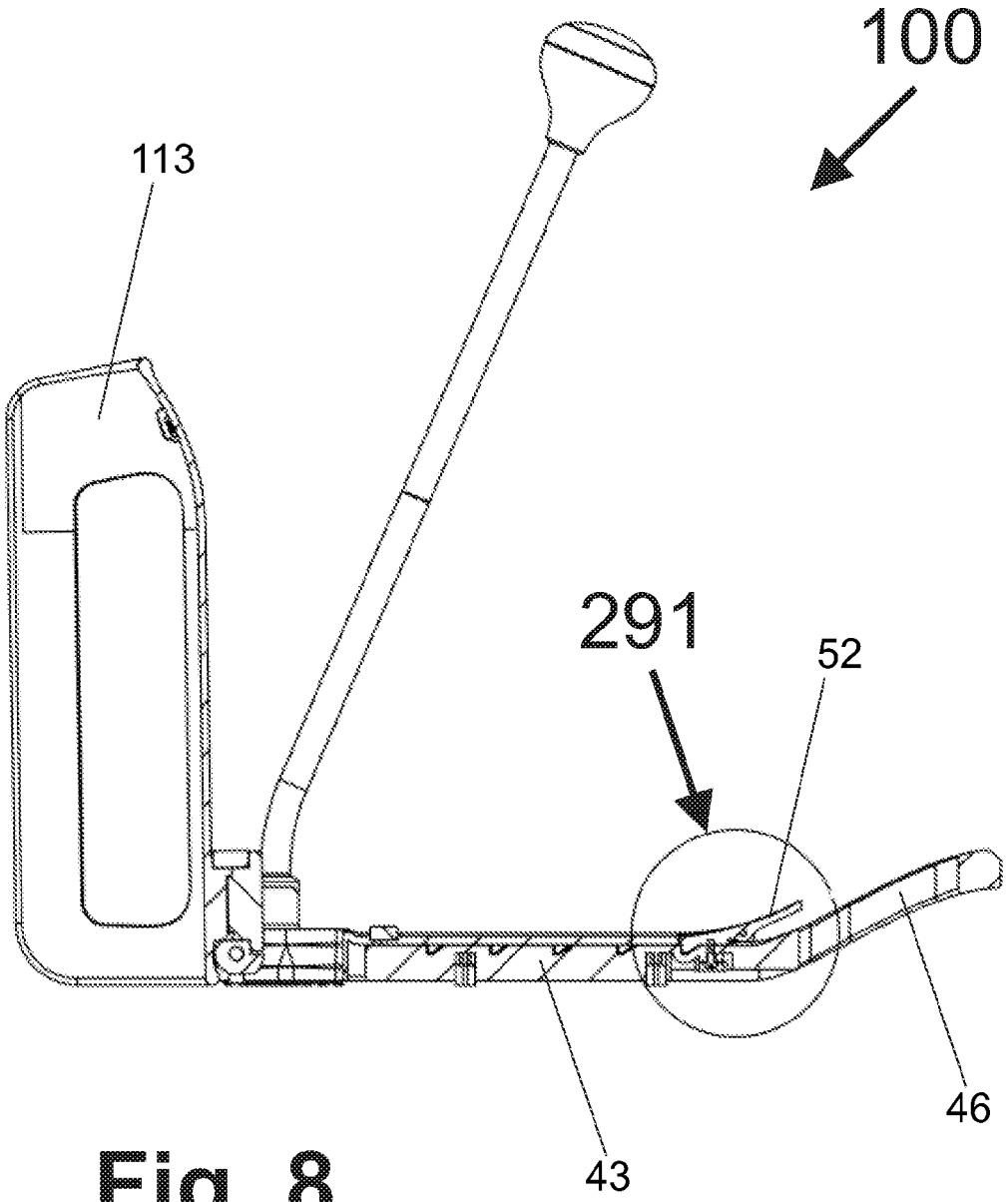
FIG. 8 is a side cross sectional view (corresponding to section A-A of FIG. 7) of the sock donning apparatus, when the caddy is in a fully tilted position and the hook member is in a fully retracted position, in accordance with some demonstrative embodiments of the present invention.
Figure 9:
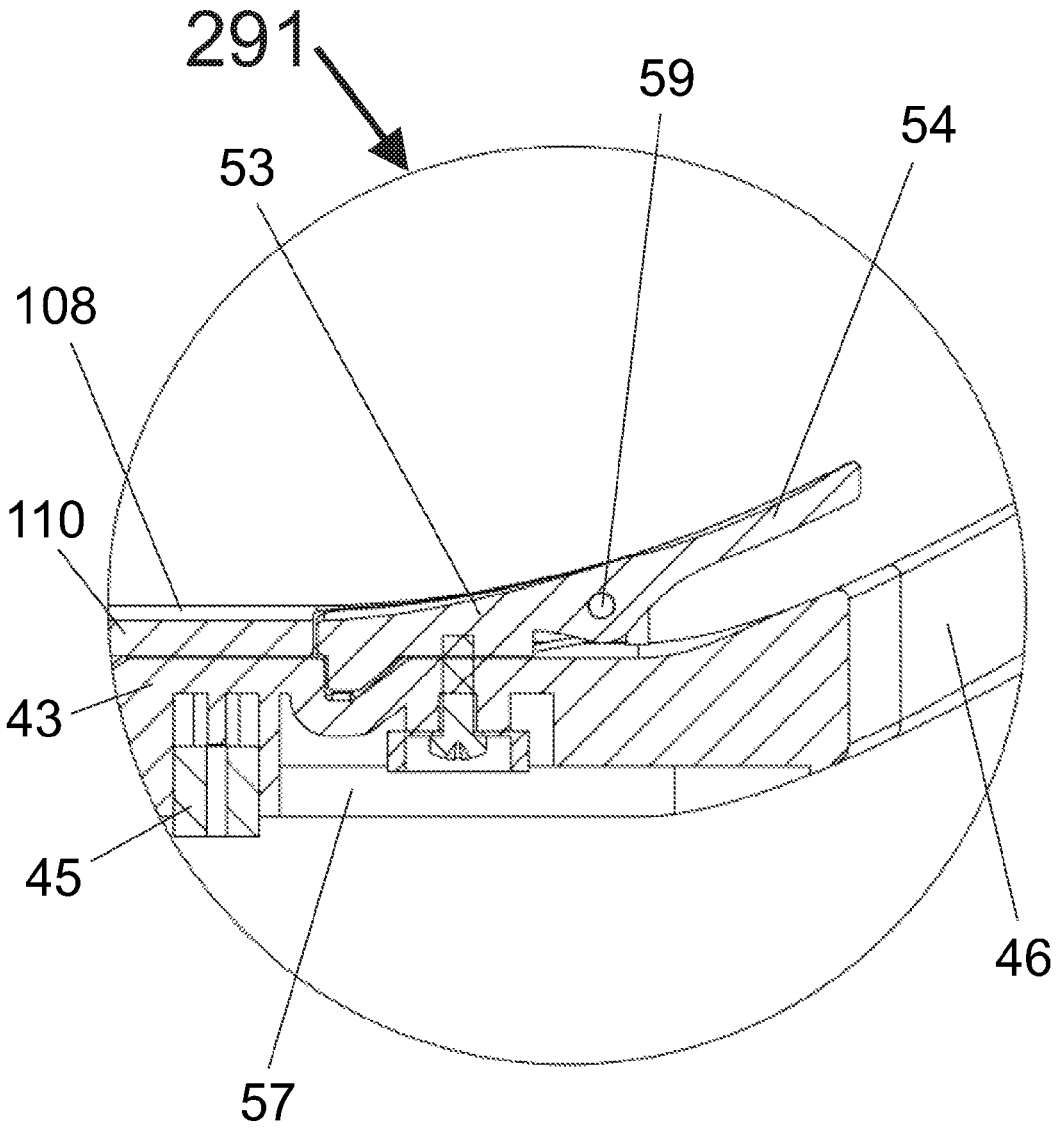
FIG. 9 is an enlargement of Detail 291 of FIG. 8, showing the details of the hook latch, in accordance with some demonstrative embodiments of the present invention.
Figure 10:
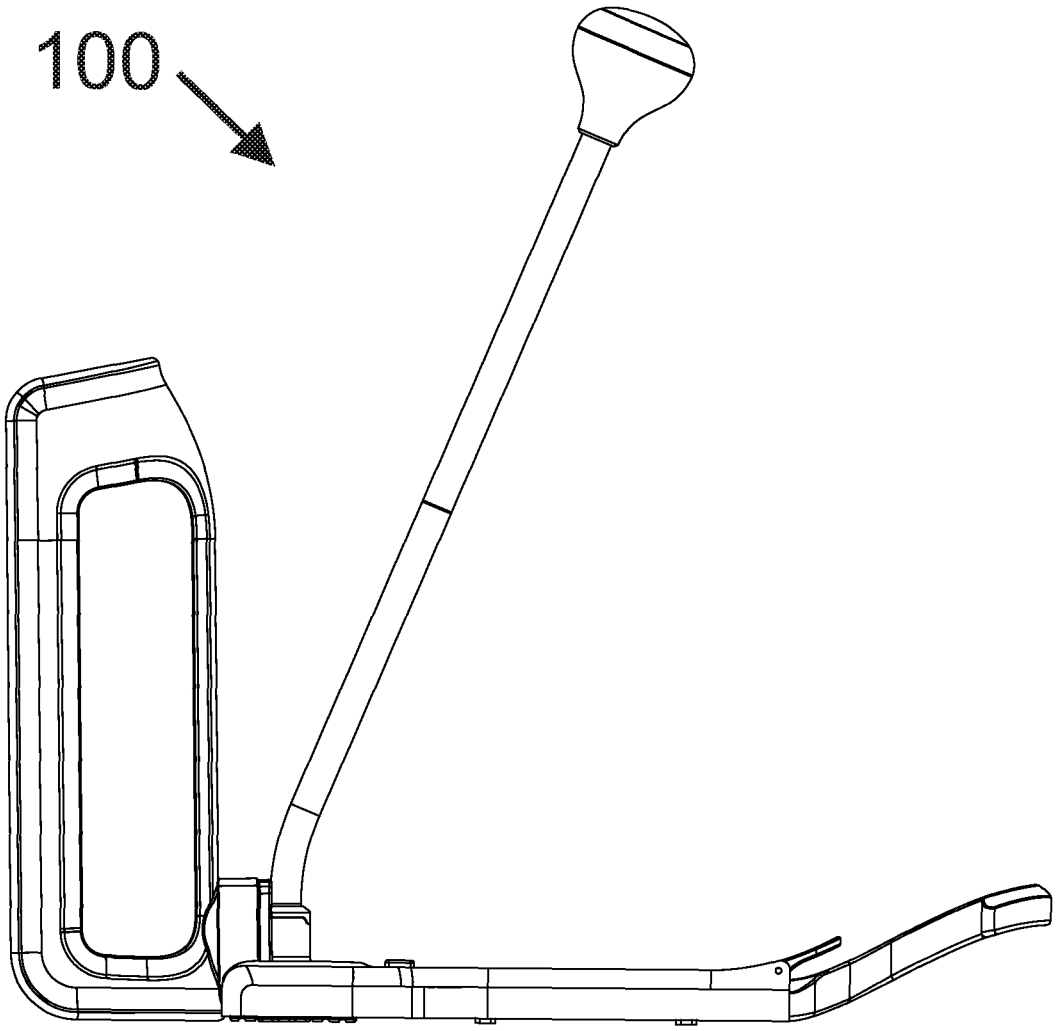
FIG. 10 is a side view of the sock donning apparatus, when the caddy is in a fully tilted position and the hook member is in a fully retracted (or closed) position, in accordance with some demonstrative embodiments of the present invention.
Figure 11:
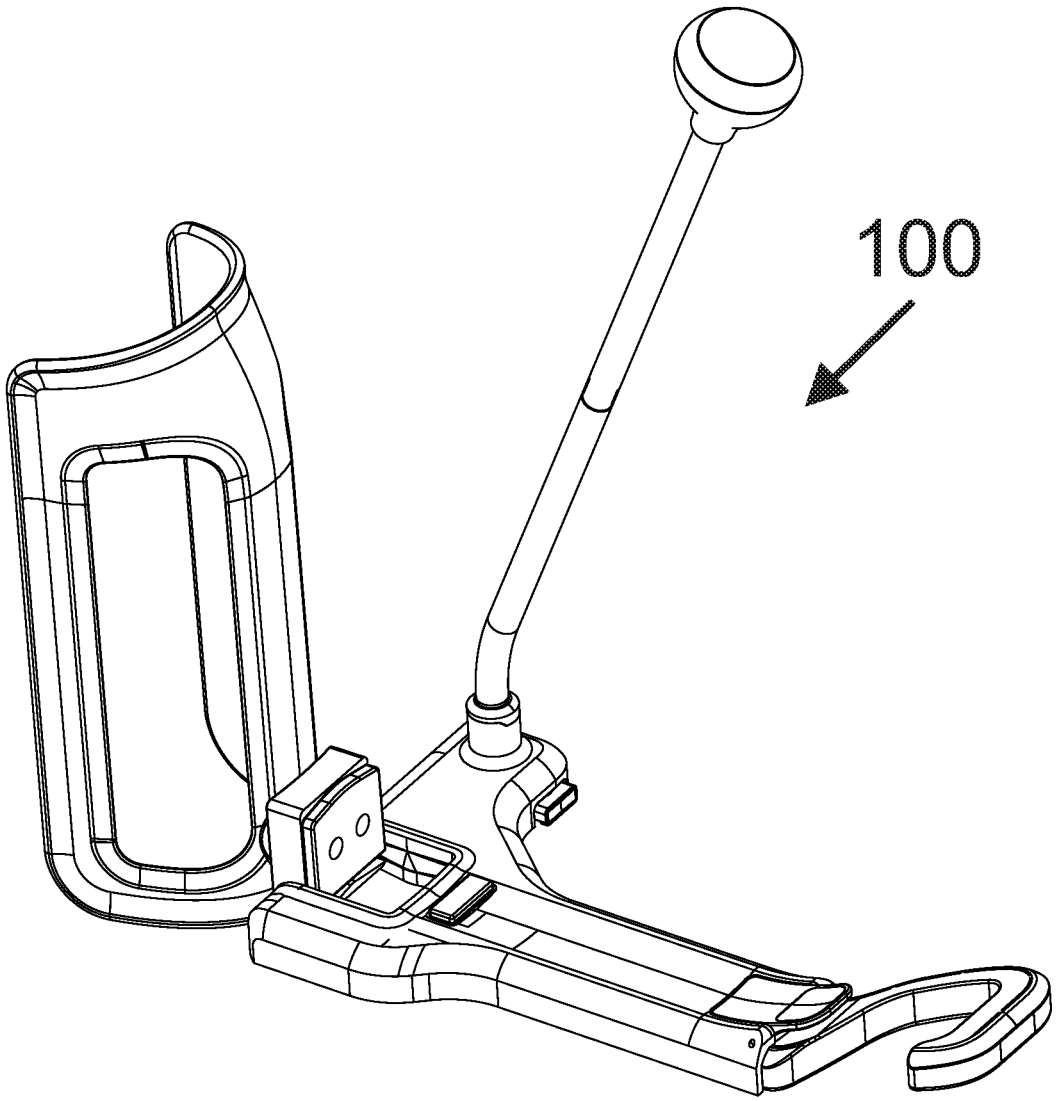
FIG. 11 is a perspective view from the top of the sock donning apparatus, when the caddy is in a fully tilted position and the hook member is in a fully retracted (or closed) position, in accordance with some demonstrative embodiments of the present invention.
Figure 12:
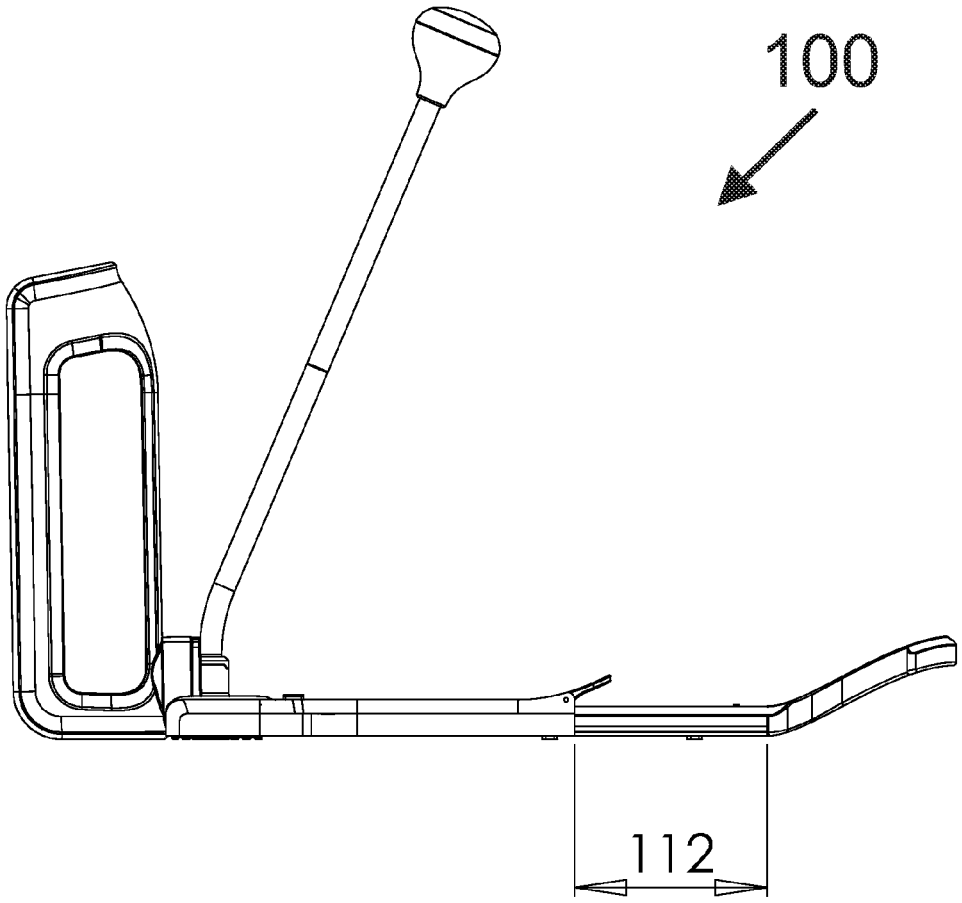
FIG. 12 is a side view of the sock donning apparatus, when the caddy is in a fully tilted position and the hook member is in an extended (or opened) position, in accordance with some demonstrative embodiments of the present invention.
Figure 13:
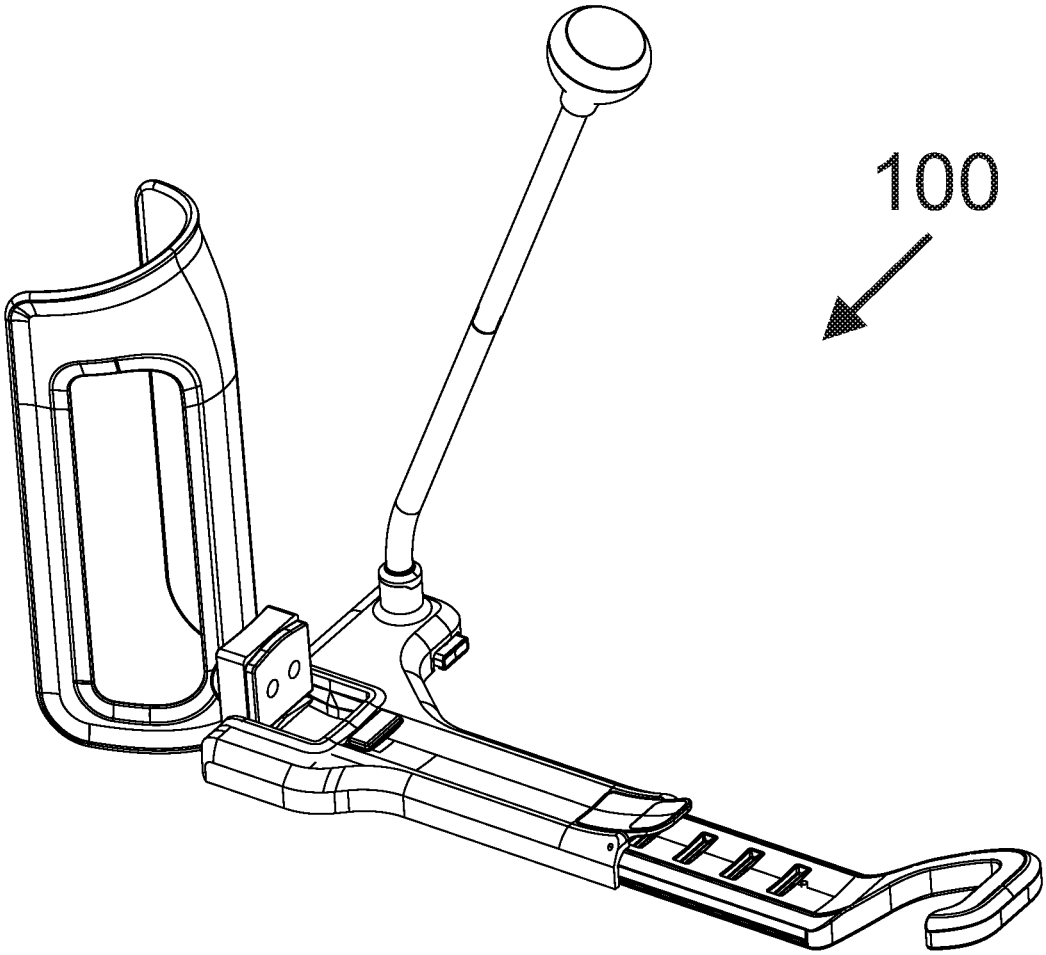
FIG. 13 is a perspective view from the top of the sock donning apparatus, when the caddy is in a fully tilted position and the hook member is in an extended (or opened) position, in accordance with some demonstrative embodiments of the present invention.

Hook member 41 is shown in a fully retracted position in FIGS. 7-11 and in an extended position in FIGS. 12-13; such that, for example, FIG. 7 shows a top view, FIGS. 8-9 show side cross sectional views, FIGS. 10 and 12 show side views, and FIGS. 11 and 13 show perspective views from the top.

Figure 14:
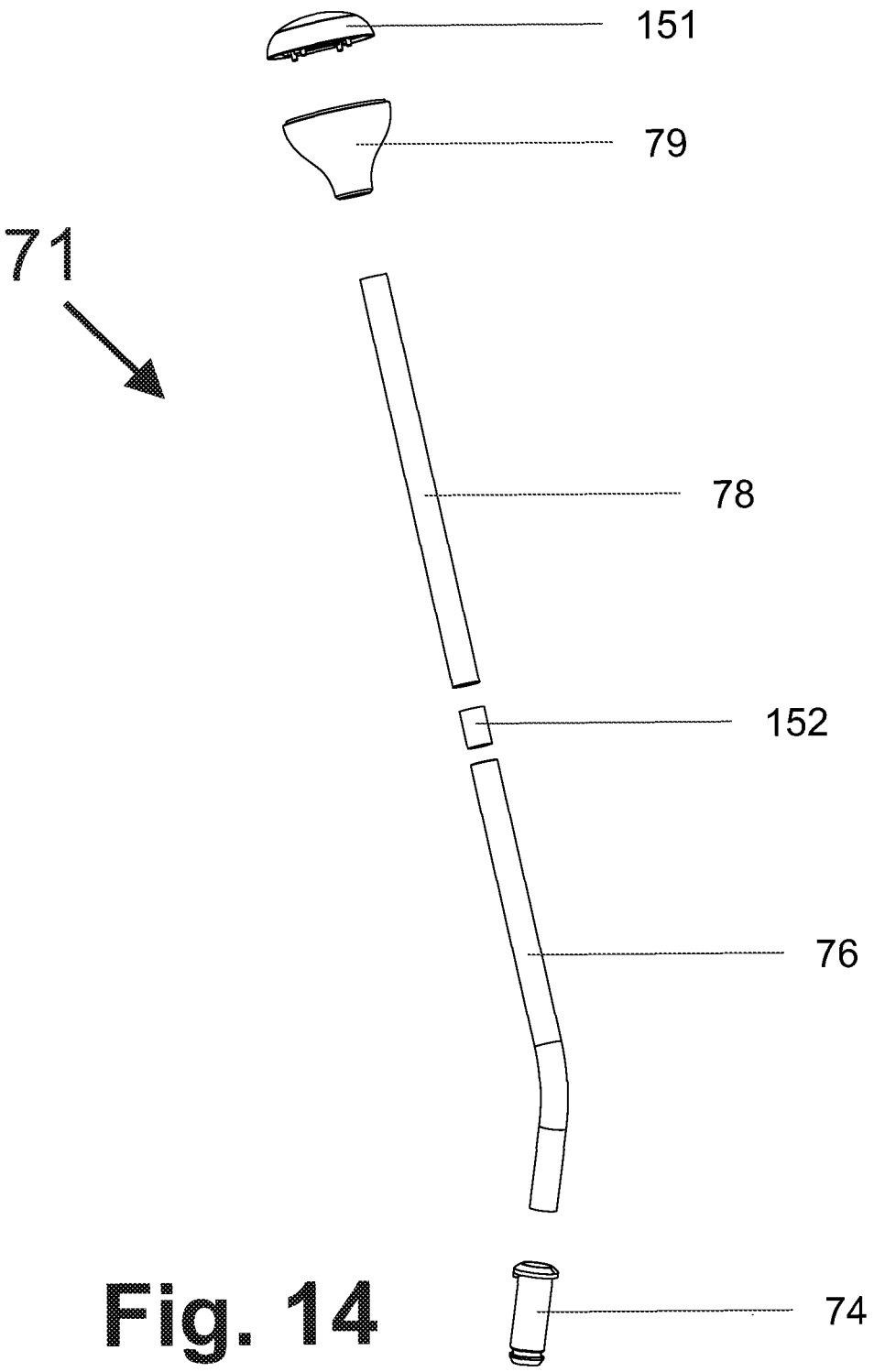
FIG. 14 is an exploded side view of a pole assembly, in accordance with some demonstrative embodiments of the present invention.
Figure 15:
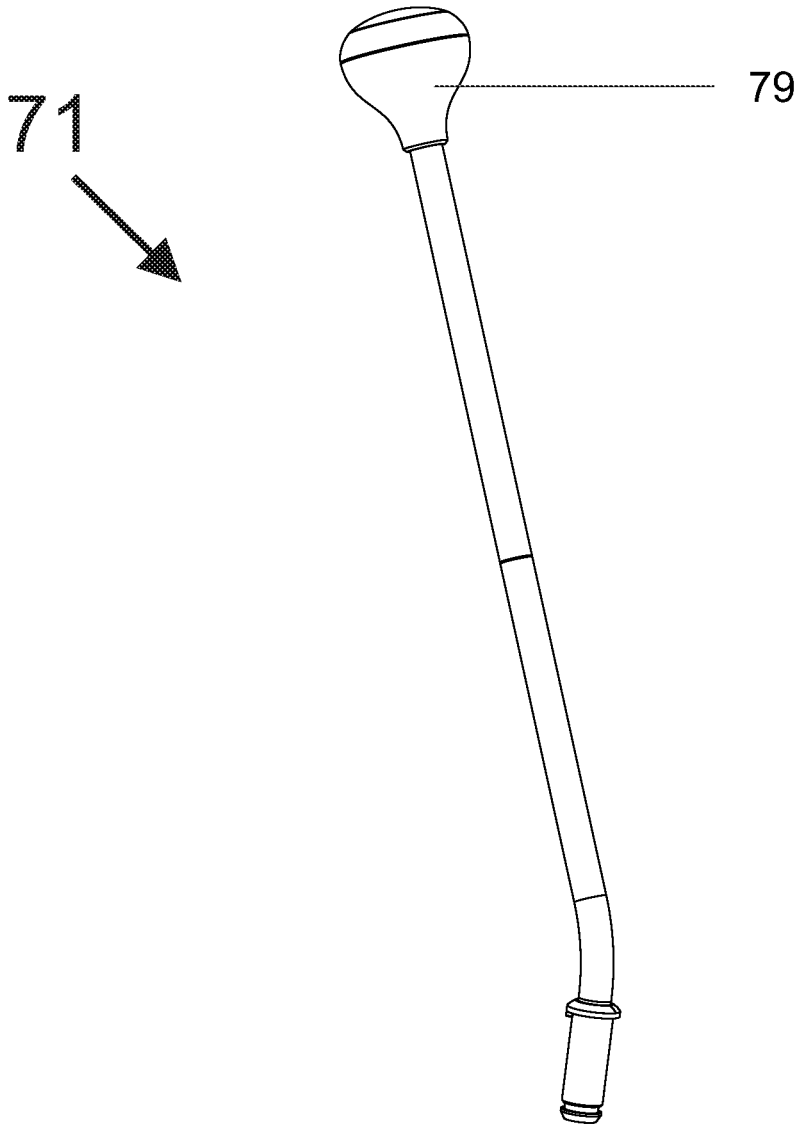
FIG. 15 is an assembled side view of the pole assembly, in a normal or un-folded state, in accordance with some demonstrative embodiments of the present invention.

An exploded side view of pole assembly 71 is shown in FIG. 14, and an assembled side view thereof is shown in FIG. 15.

Figure 16:
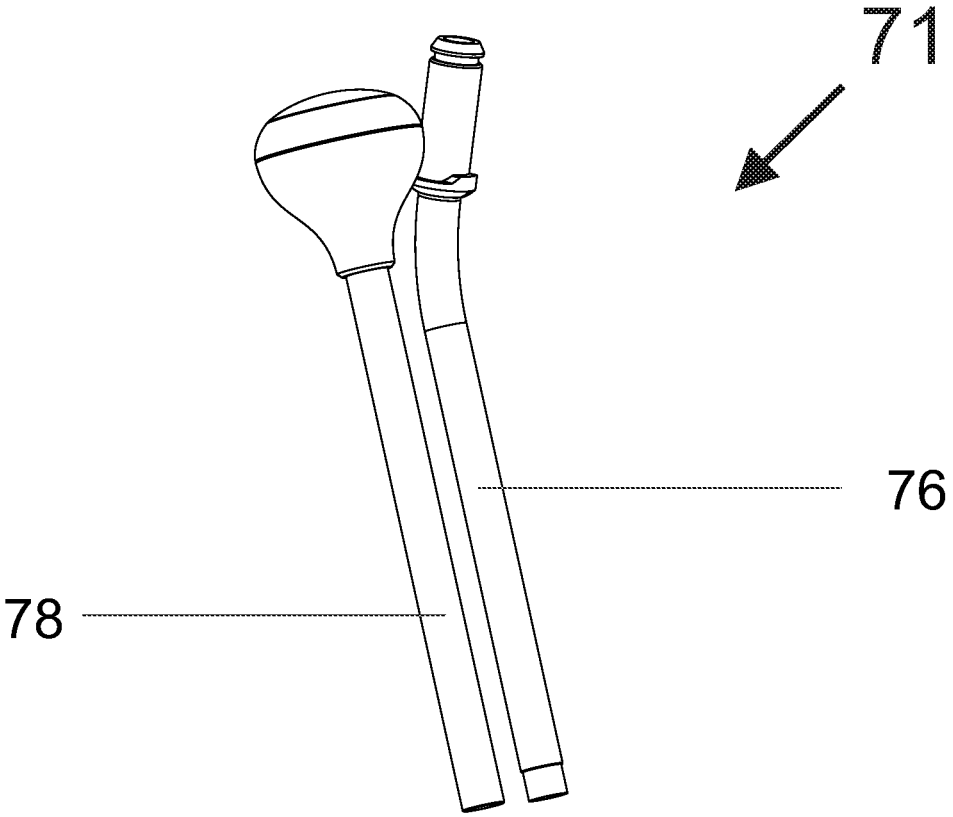
FIG. 16 is a side view of some components of the pole assembly, when dismantled or folded or dis-assembled, in accordance with some demonstrative embodiments of the present invention.
Figure 17:
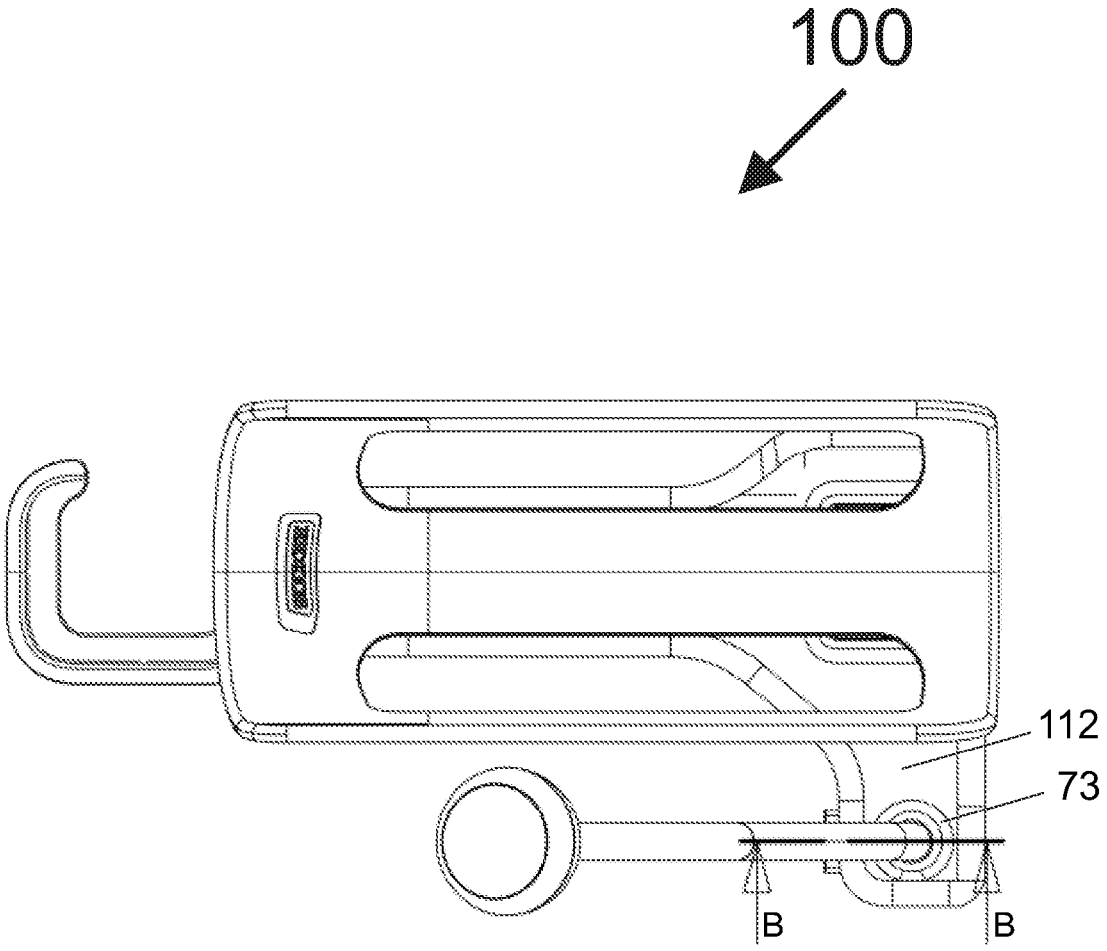
FIG. 17 is a top view of the sock donning apparatus in the rest position, in accordance with some demonstrative embodiments of the present invention.
Figure 18:
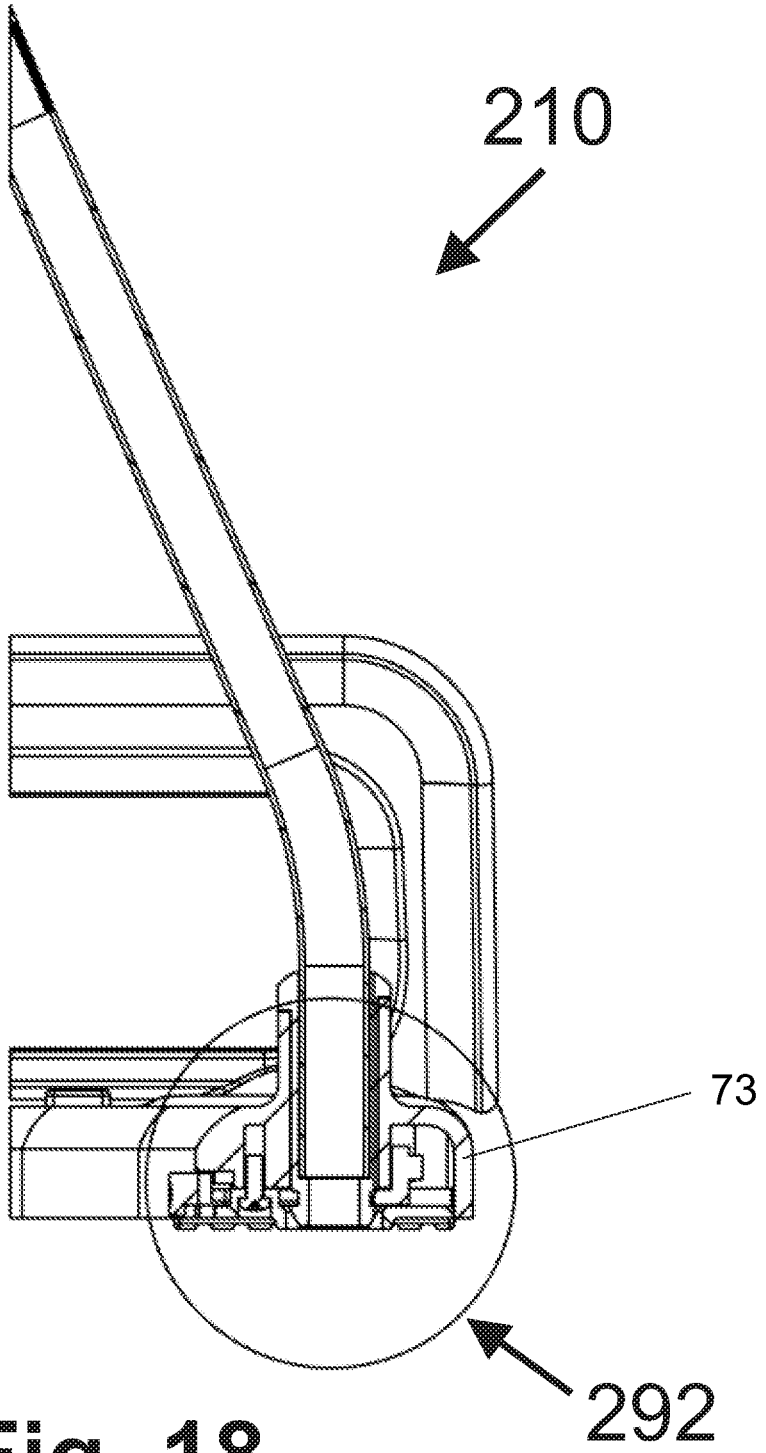
FIG. 18 is a side cross sectional view (corresponding to section B-B of FIG. 17) of a portion of the sock donning apparatus, showing connection to a head portion of a socket for receiving the pole assembly of FIG. 14, in accordance with some demonstrative embodiments of the present invention.
Figure 19:
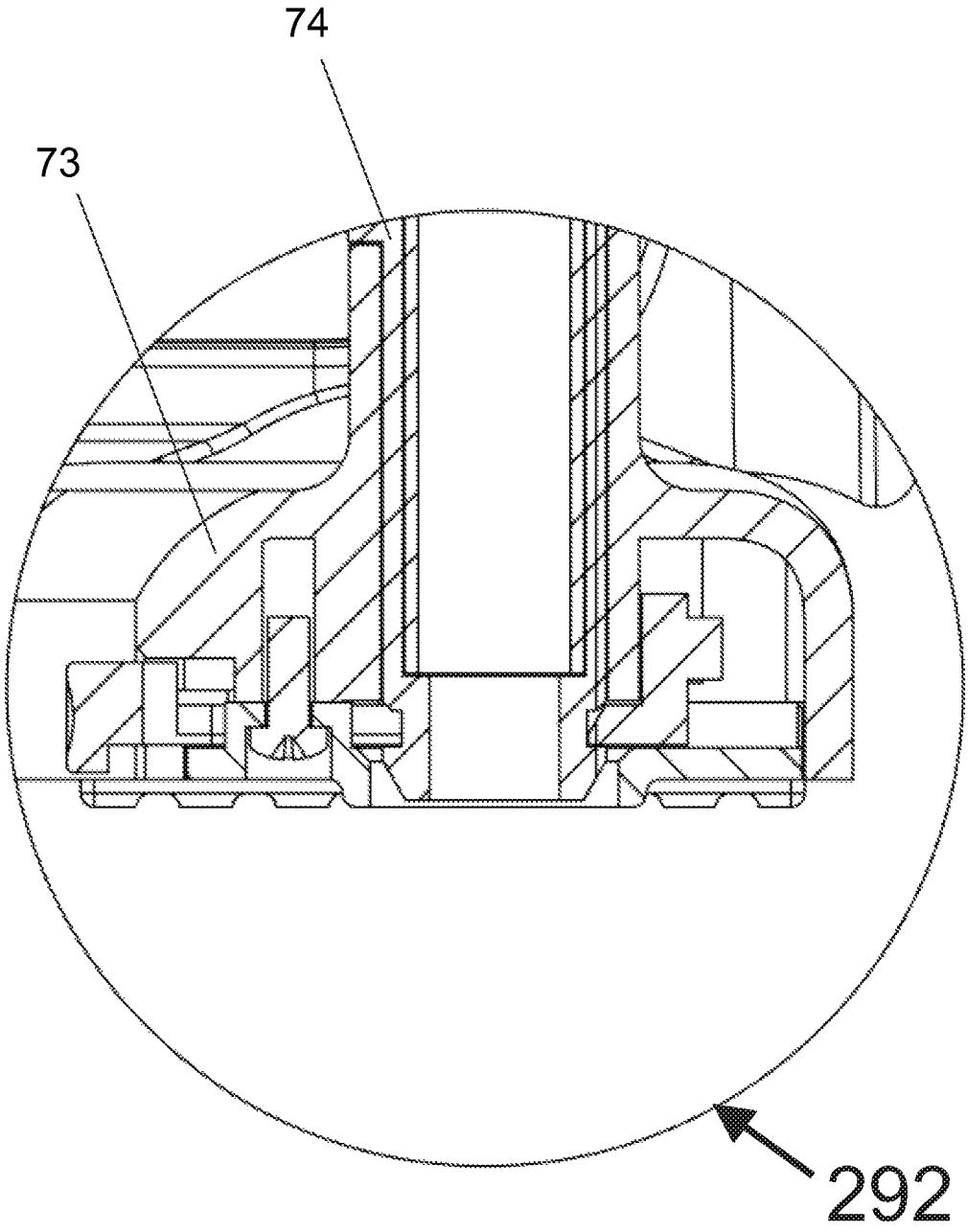
FIG. 19 is an enlargement of Detail 292 (the pole latch) of FIG. 18, in accordance with some demonstrative embodiments of the present invention.

As shown in FIGS. 6A and 6B, and also in FIG. 17, which is a top view of apparatus 100, a socket 73 may protrude upwardly from head portion 112 of base 101, and may be connected thereto in the manner shown in FIGS. 18-19, which are side cross sectional views. To assist in coupling pole assembly 71 to base 101, a cup attachment 74 is received within socket 73, to which a bent pole section 76 is releasably and movably connectable. A straight pole section 78 may be releasably connectable to bent pole section 76, allowing pole assembly 71 to be dismantled as shown in FIG. 16. In this manner, pole assembly 71 may be moved while received within attachment 74, so that knob 79 will be more to accessible to a user who desires to perform a sock donning operation with the apparatus 100.

Referring back to FIGS. 6A and 6B, caddy 113 is advantageously able to be both tilted about a horizontal axis and rotated about a vertical axis during a sock donning operation, depending upon the physical capabilities of the leg (or foot) of a user. To facilitate or to accomplish this multifaceted capability, a rectilinear tilt unit 62 may be fitted within the interspace between the two head portions 111 and 112 of base 101. A tubular and annular pin 64 introducible through a similarly shaped recess formed within a forwardly positioned projection 67 of tilt unit 62, may be coupled to two opposed pin holders 119 protruding from the inner face of head portions 111 and 112, respectively thereby allowing tilt unit 62 and caddy 113 to pivot about pin 64 when a suitable force is applied by the leg of the user. Tilt unit 62 may have a central through-hole 61, through which circular protruding part 118 of caddy 113 located in the vicinity of forward terminal edge 160 passes. A circular projection 86 protruding from flange 83 and introducible into through hole 61 may be connected to the bottom face of protruding part 118, e.g., by screws or other suitable connection mechanism; thereby allowing flange 83 and protruding part 118 to rotate in unison about the central axis of through-hole 61 while an outer element of protruding part 118 is in supporting relation with the rim of through-hole 61. In accordance with the present invention, limited rotation in unison about the central axis of through-hole 61 may be required to allow the user deciding from which side of the apparatus 100 he wished to insert his leg (or his foot) into the sock (which is already slipped over the rearward terminal edge 158 of caddy 113), so as to prevent the user's heel from encountering the leg of the chair.

Flange 83 may serve as an angular limiter for the rotational displacement of caddy 113 about the central axis of through hole 61. Cooperating with flange 83 is inner face 122 of head portions 111 and 112, a lower region of which may be angularly recessed with respect to an upper, substantially straight and unrecessed region thereof. This angular recess may allow flange 83 to rotate when caddy is at the rest position for a predetermined angular distance, e.g., up to 15 or 20 or 30 or 40 degrees in either rotational direction, until the flange contacts inner face 122, yet prevents flange 83 from rotating when caddy 113 is tilted.

Figure 20:
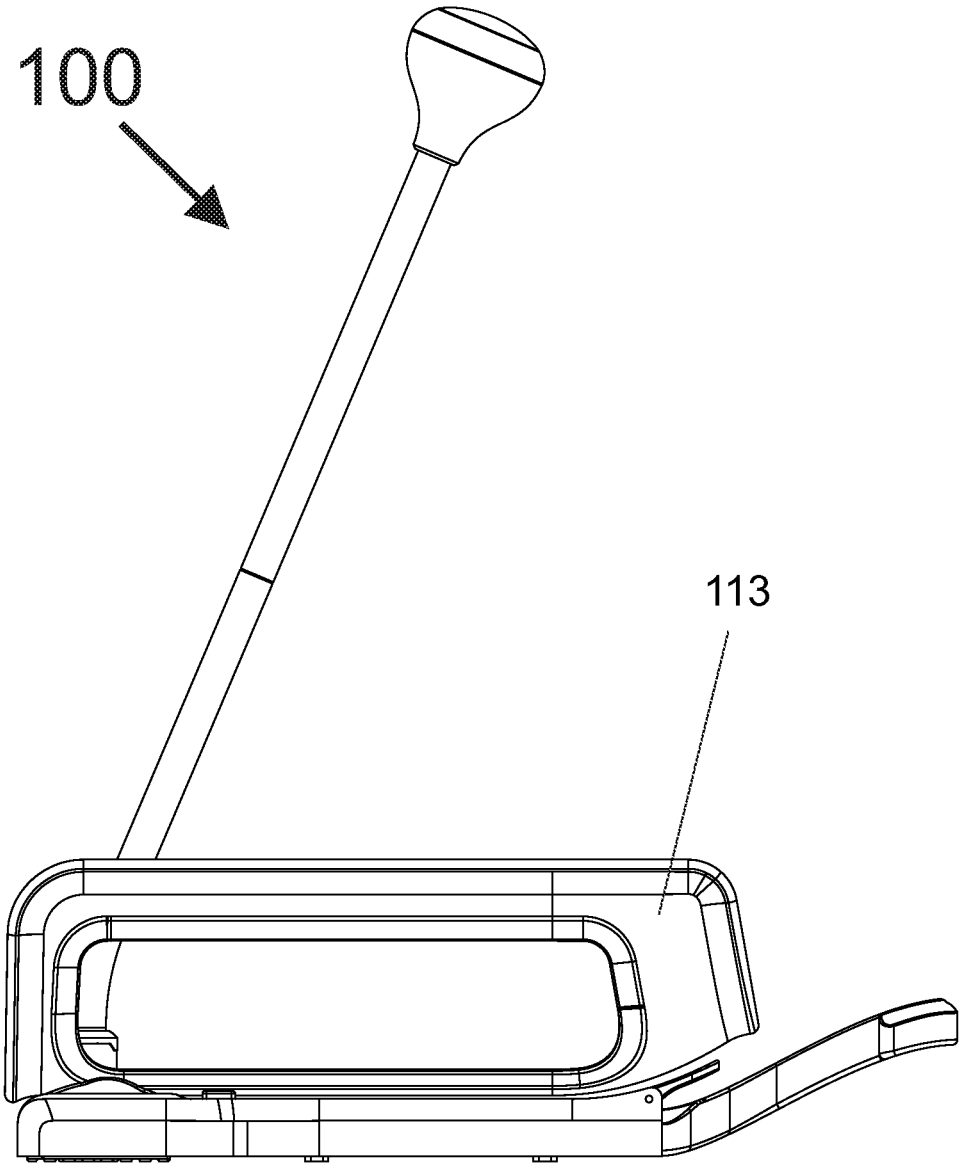
FIGS. 20-22 are side views of the sock donning apparatus, showing the caddy in three tilted positions, respectively, with respect to a horizontal axis, in accordance with some demonstrative embodiments of the present invention.
Figure 21:
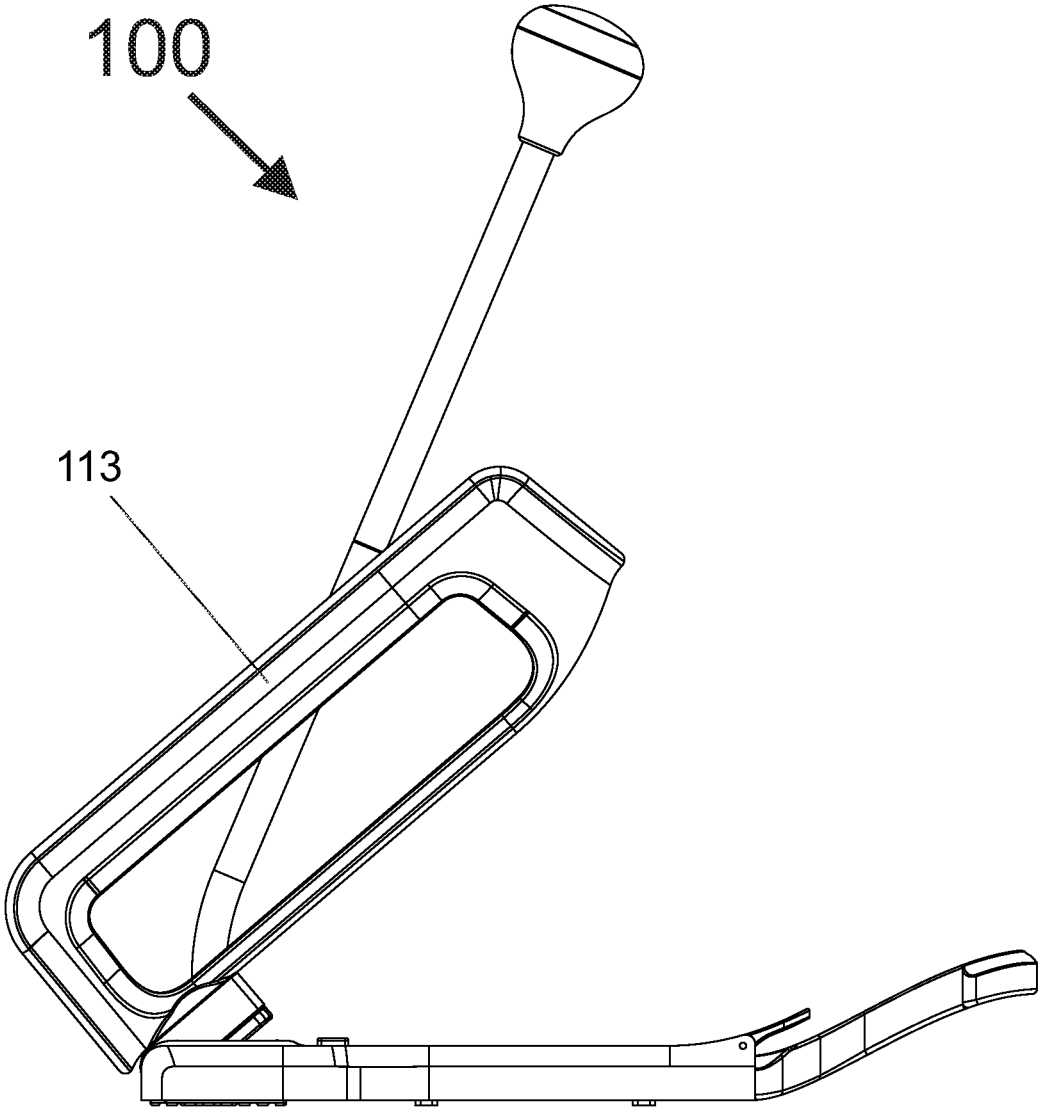
Figure 22:
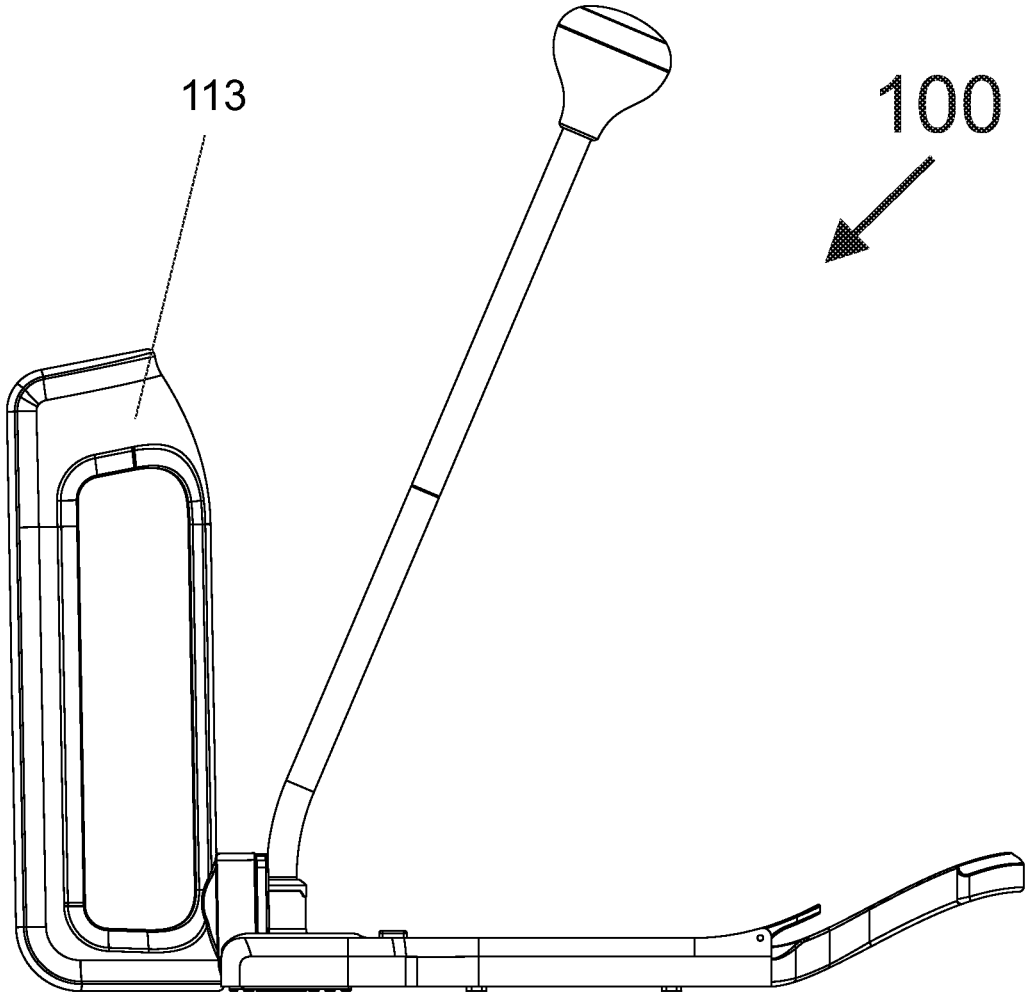
Figure 23:
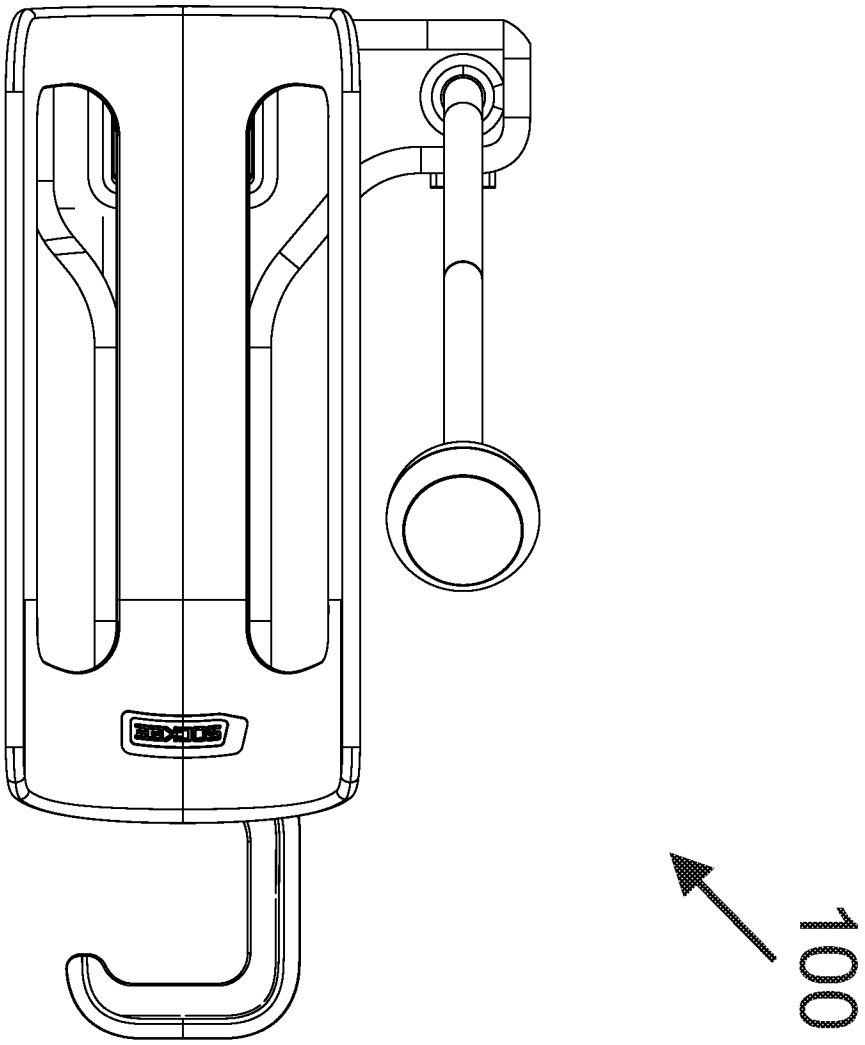
FIGS. 23-25 are top views of the sock donning apparatus, showing the caddy in three tilted positions, respectively, with respect to a horizontal axis, in accordance with some demonstrative embodiments of the present invention.
Figure 24:
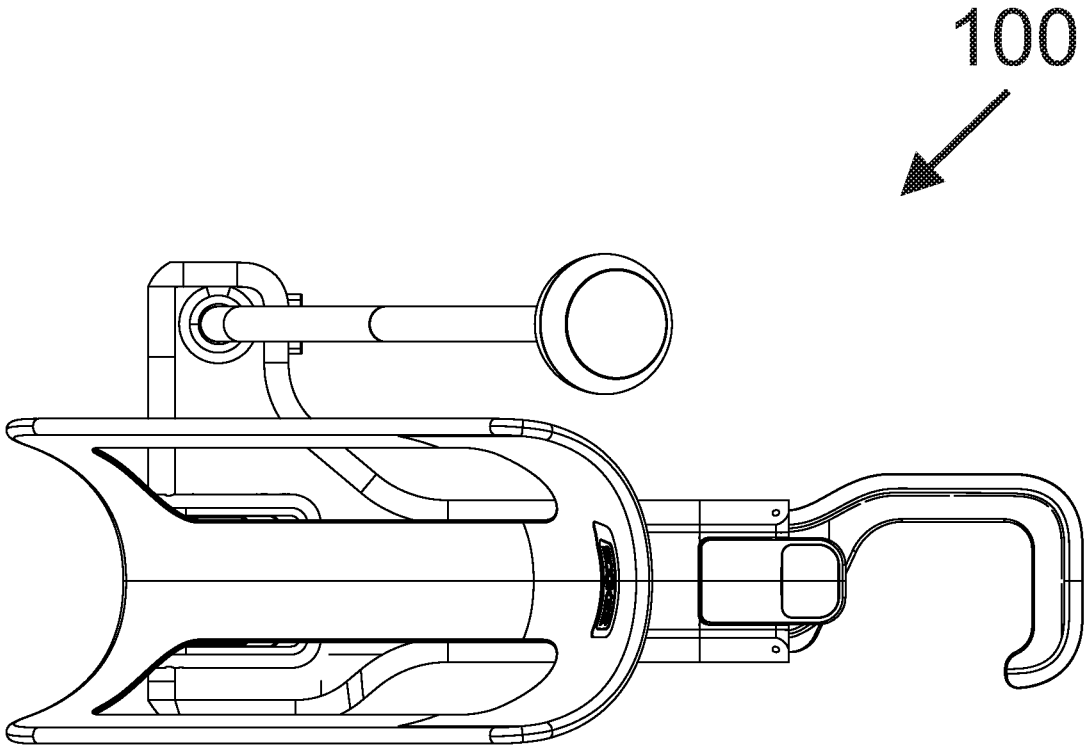
Figure 25:
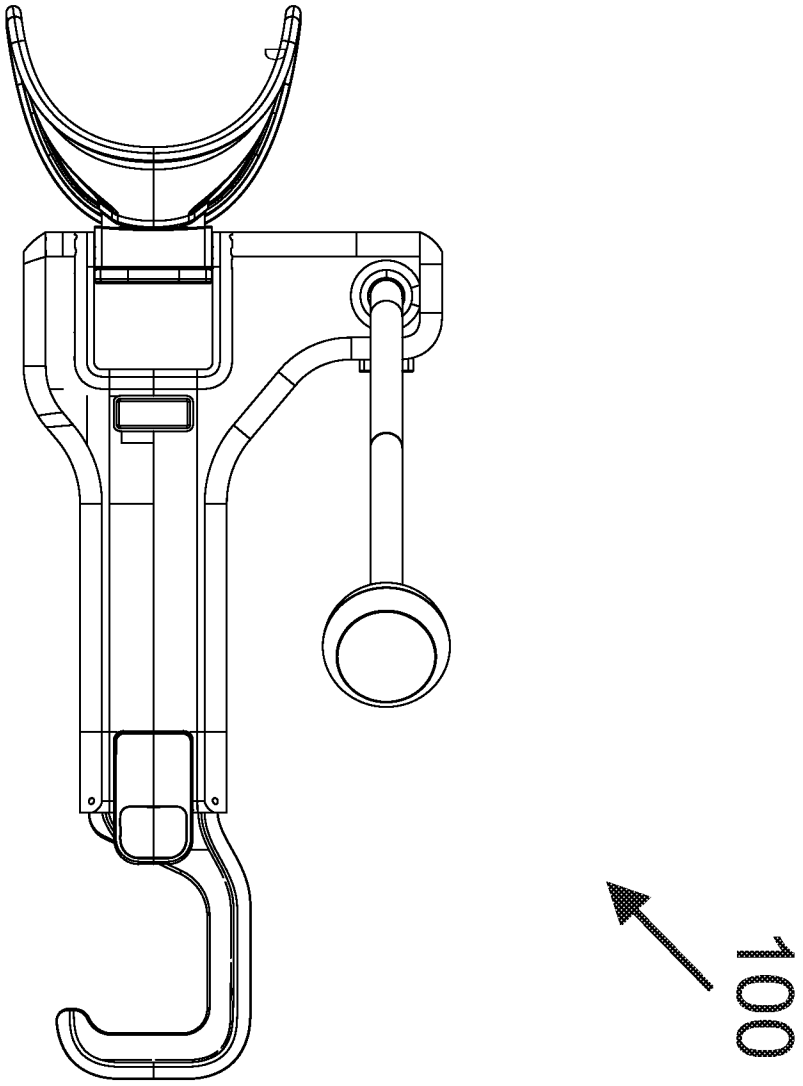

FIGS. 20-22 illustrate side views of apparatus 100, and FIGS. 23-25 illustrate top views of apparatus 100, showing caddy 113 in three tilted positions with respect to a horizontal axis. For example, FIGS. 20 and 23 correspond to a rest position; FIGS. 21 and 24 correspond to a middle position or intermediate position; and FIGS. 22 and 25 correspond to a fully-opened position.

Figure 26:
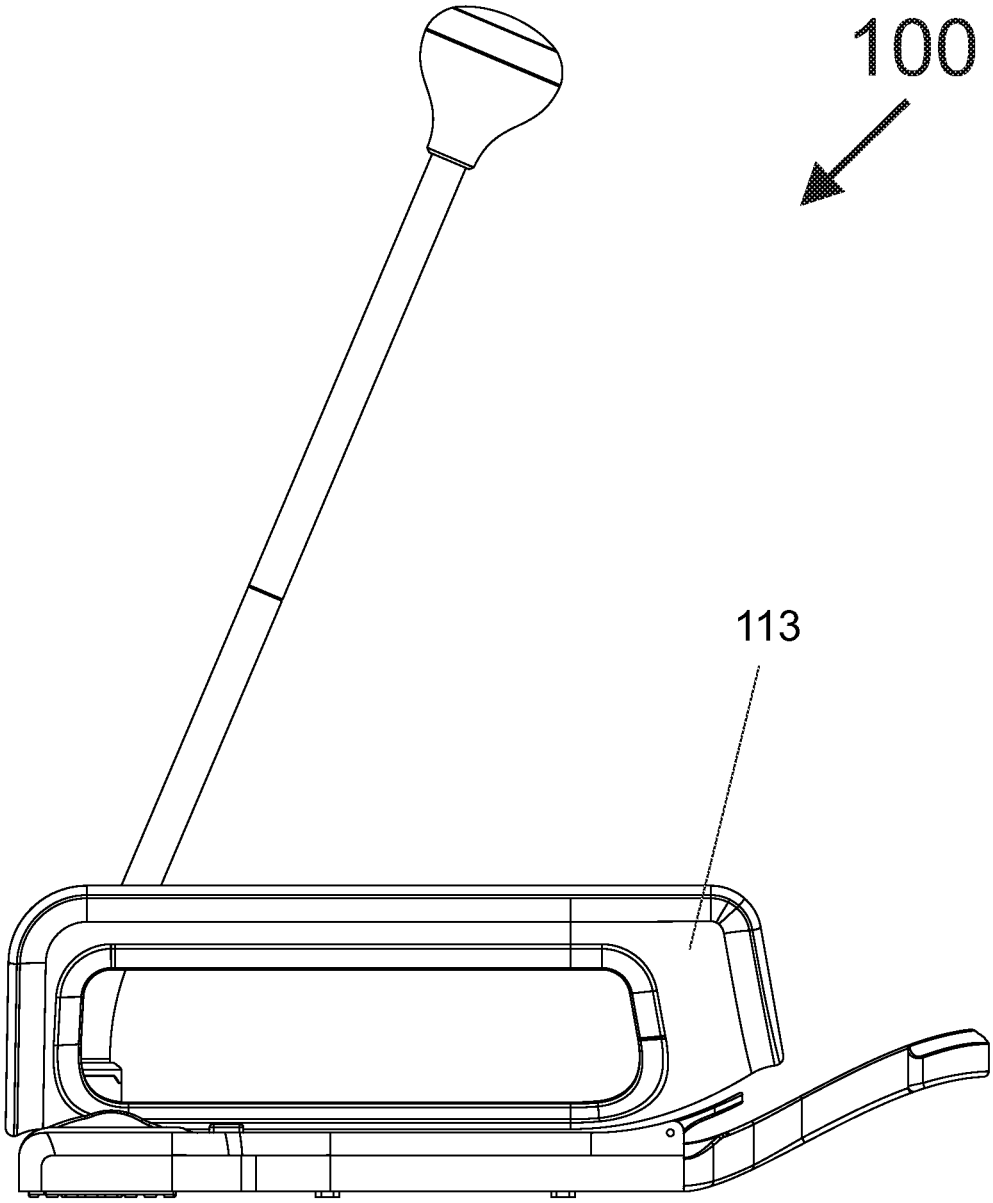
FIGS. 26-27 are side views of the sock donning apparatus, showing the caddy in two rotated positions, respectively, with respect to a vertical axis in accordance with some demonstrative embodiments of the present invention.
Figure 27:
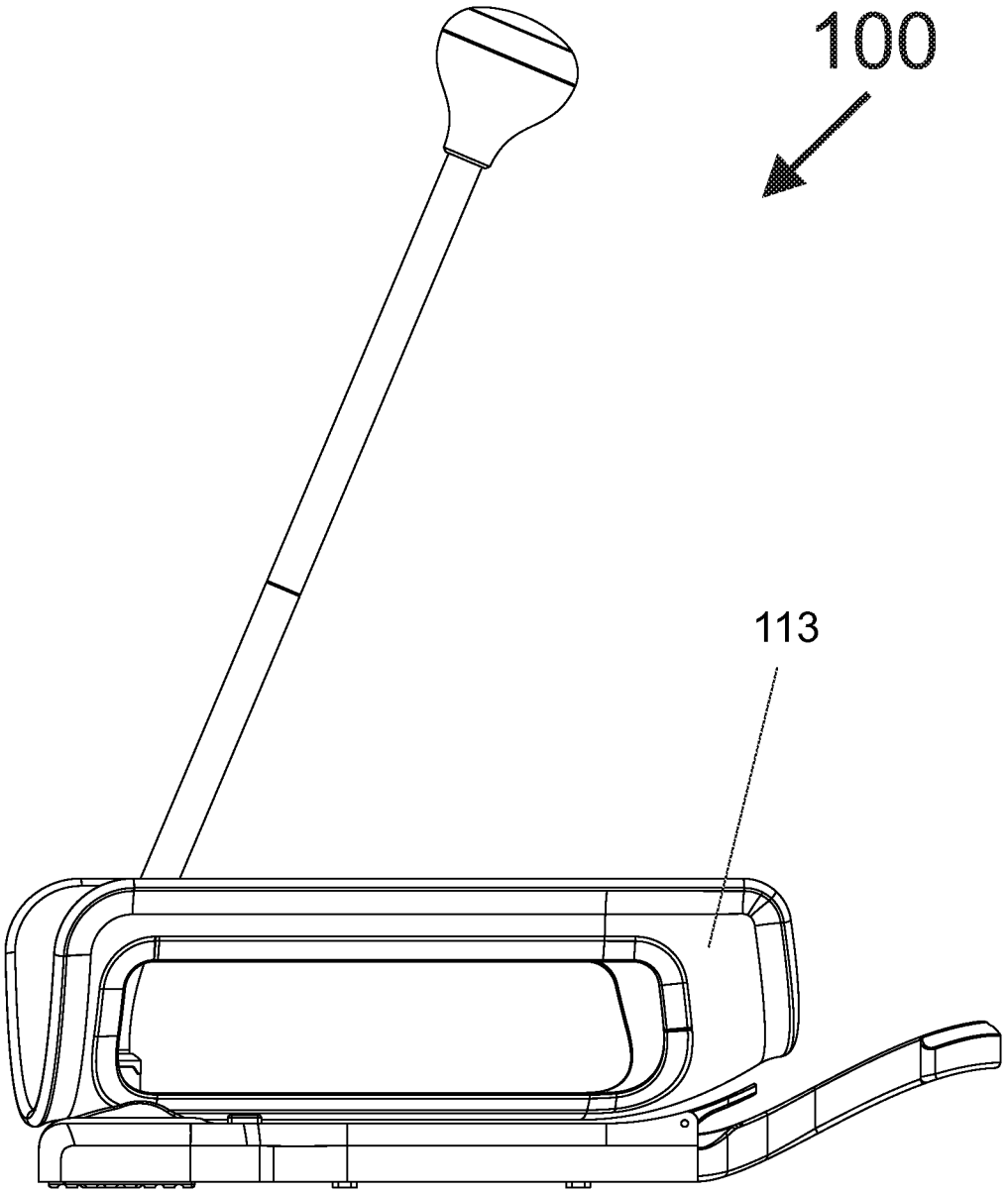
Figure 28:
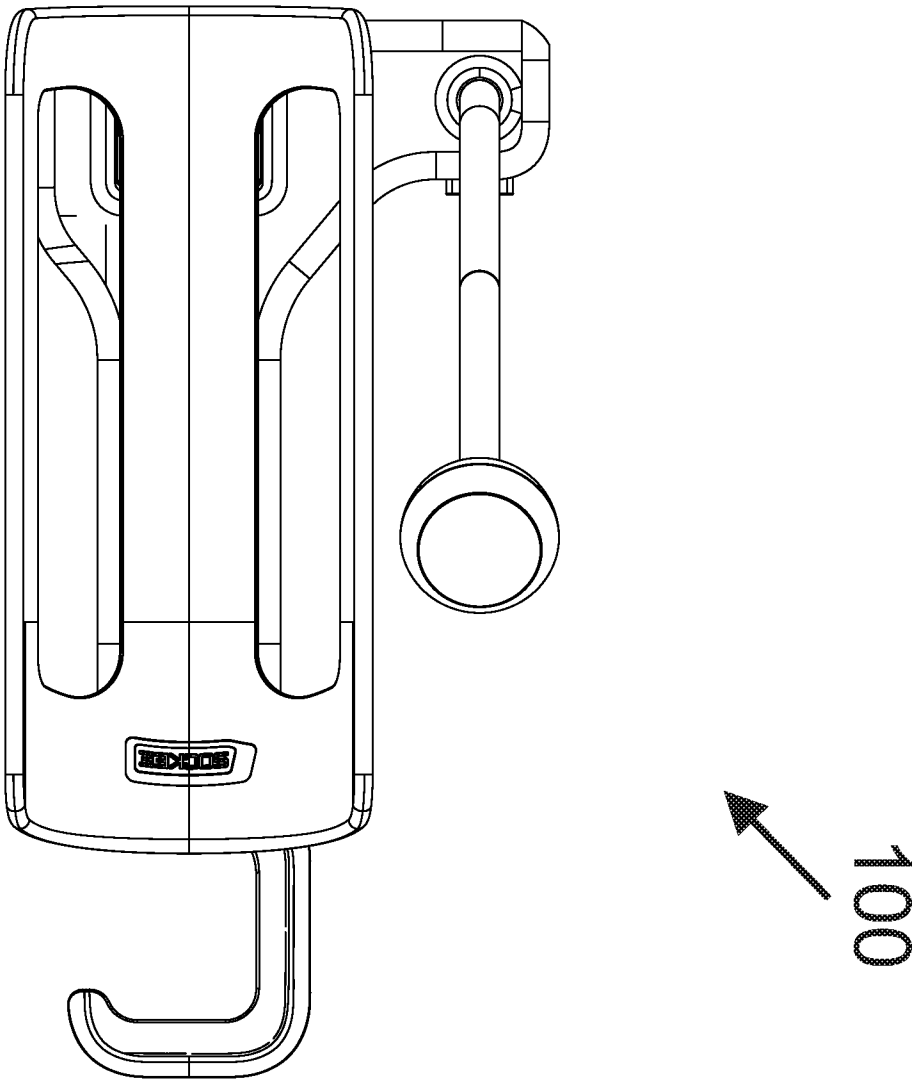
FIGS. 28-29 are top views of the sock donning apparatus, showing the caddy in two rotated positions, respectively, with respect to a vertical axis, in accordance with some demonstrative embodiments of the present invention.
Figure 29:
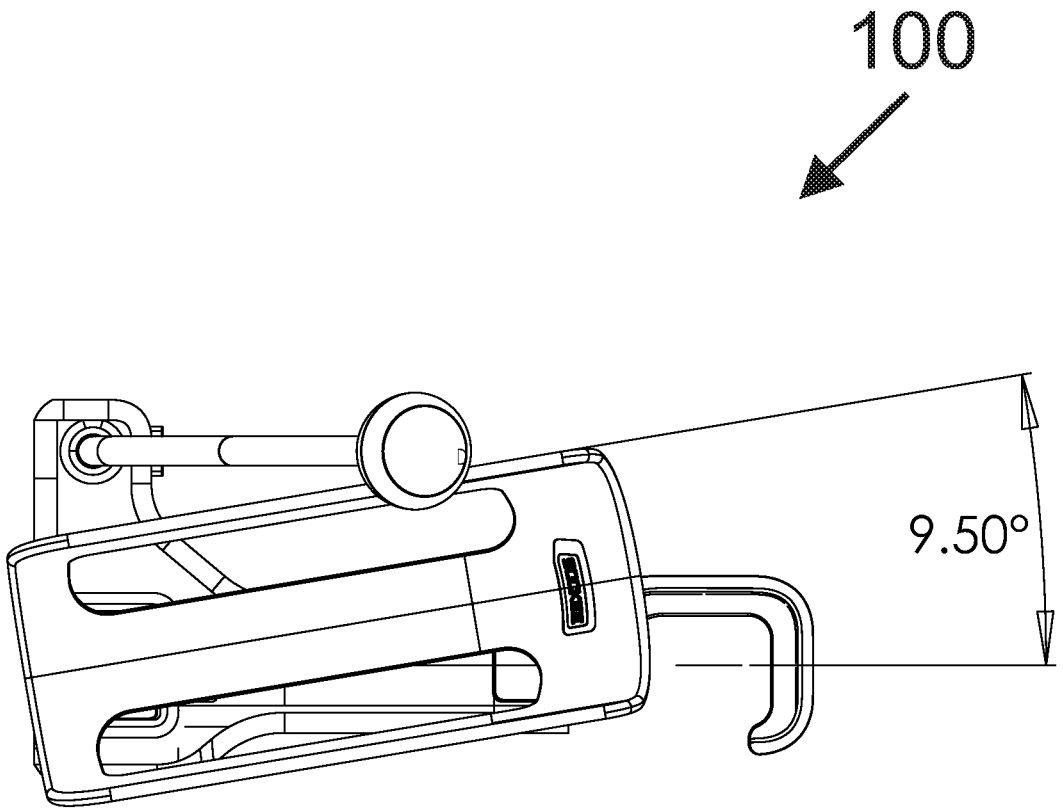

FIGS. 26-27 illustrate side views of apparatus 100 and FIGS. 28-29 illustrate top views of apparatus 100, showing caddy 113 in rotated positions with respect to a vertical axis. For example, FIGS. 26 and 28 correspond to zero yaw position; whereas FIGS. 27 and 29 correspond to a full yaw position (e.g., allowing approximately 5 or 7 or 9 or 9.5 or 10 or 12 degrees of yaw to each side).

In operation, hook member 41 may initially be set to a selected longitudinal position that provides optimal comfort to the user, since the user may not be able to bend over (entirely or partially). A sock positioned inside out may then be slipped over rearward terminal edge 158 of caddy 113, for example when the caddy is set to a completely vertical position as shown in FIG. 22, after which the caddy may be set to the rest position shown in FIG. 20. The user, or alternatively a caretaker or assistant, may affix hook 49 to the leg of a chair (or other furniture) on top of which the user is sitting, or to any other desired stationary or relatively-stationary element. Generally, the optimal length may be set once, since the user may repeat the sock donning operations from the same position (e.g., while sitting on a chair or bed or other seat or furniture). Pole assembly 71 may be used to conveniently position the apparatus 100, without the need to bend down, until the hook 49 is engaged with the leg of the chair (or of any other relatively stationary element that can provide a reactive force during a sock donning operation). Once the hook 49 is engaged with the leg of the chair, the pole assembly 71 may be used to adjust the direction of caddy 113 to match it to the direction of the first leg. After the user wears the sock on the first leg, the user may further utilize the pole assembly 71 to conveniently disengage the hook 49 from the leg of the chair and to reposition the apparatus 100, until the hook 49 is engaged with another leg of the chair, which may be closer to the second leg of the user. Once the hook 49 is engaged with the other leg of the chair, the pole assembly 71 may be utilized to adjust the direction of caddy 113 to match it to the direction of the second leg, again, without the need to bend down (at all, or partially).

While the user is sitting, or otherwise positioned, to the rear of caddy 113, the foot of the user may then be brought in close proximity to the closed end of the sock near rearward terminal edge 158, and may be pushed within the interior of the elongated caddy 113. A moment or a force which may be applied by the foot being introduced within the interior of the caddy 113 causes the caddy 113 to be pivoted, such that the rearward edge thereof becomes positioned higher than its forward edge. While the foot of the user is being inserted within its interior, the caddy 113 is able to slightly rotate about a substantially vertical axis, in response to the direction and magnitude of the force applied by the foot. As the foot of the user continues to be pushed into the sock, the closed end of the sock is gradually displaced towards the forward terminal edge 160 of caddy 113. Likewise, the open end of the sock is gradually slipped off the rearward terminal edge 158 to allow the sock to fit the user's foot, until the toes of the user are fully inserted into the toe portion of the sock and the heel of the user is fully inserted into the heel portion of the sock. As the foot of the user is being pushed downwardly into the sock to ensure proper engagement, caddy 113 rotates about pin 64 in response to the foot position, assuming a final position or an advanced position, for example an intermediate position as shown in FIG. 21. The rounded terminal edge 158 of caddy 113 may enable a smooth sock donning process. With the use of two identical devices, two socks may be positioned on both feet of the user, simultaneously or concurrently or in parallel, or in partially-overlapping time slots.

Some embodiments of the present invention may further comprise a method or a process of donning (or wearing, or putting-on) a sock, by performing the operations described above, and/or by using the apparatus 100 and its components as described above. In some embodiments, the method or process may be integrally related to the apparatus 100, or to a generally similar apparatus for donning socks; such that, for example, the method may require operations which are performed through, or via, or by using, the apparatus 100 or a similar apparatus.

In accordance with the present invention, a device for putting-on socks may comprise or may provide one or more features, for example: The device may comprise a hook or anchor, or other connecting element or attachment element or anchoring element, enabling the user to immobilize the device or to anchor the device to a chair or furniture or other generally-unmoving article, thereby allowing efficient and easy utilization of the device by a single user, independently or autonomously and without requiring assistance of other person's, and without requiring the user to bend down (entirely or partially).

Figure 30A:
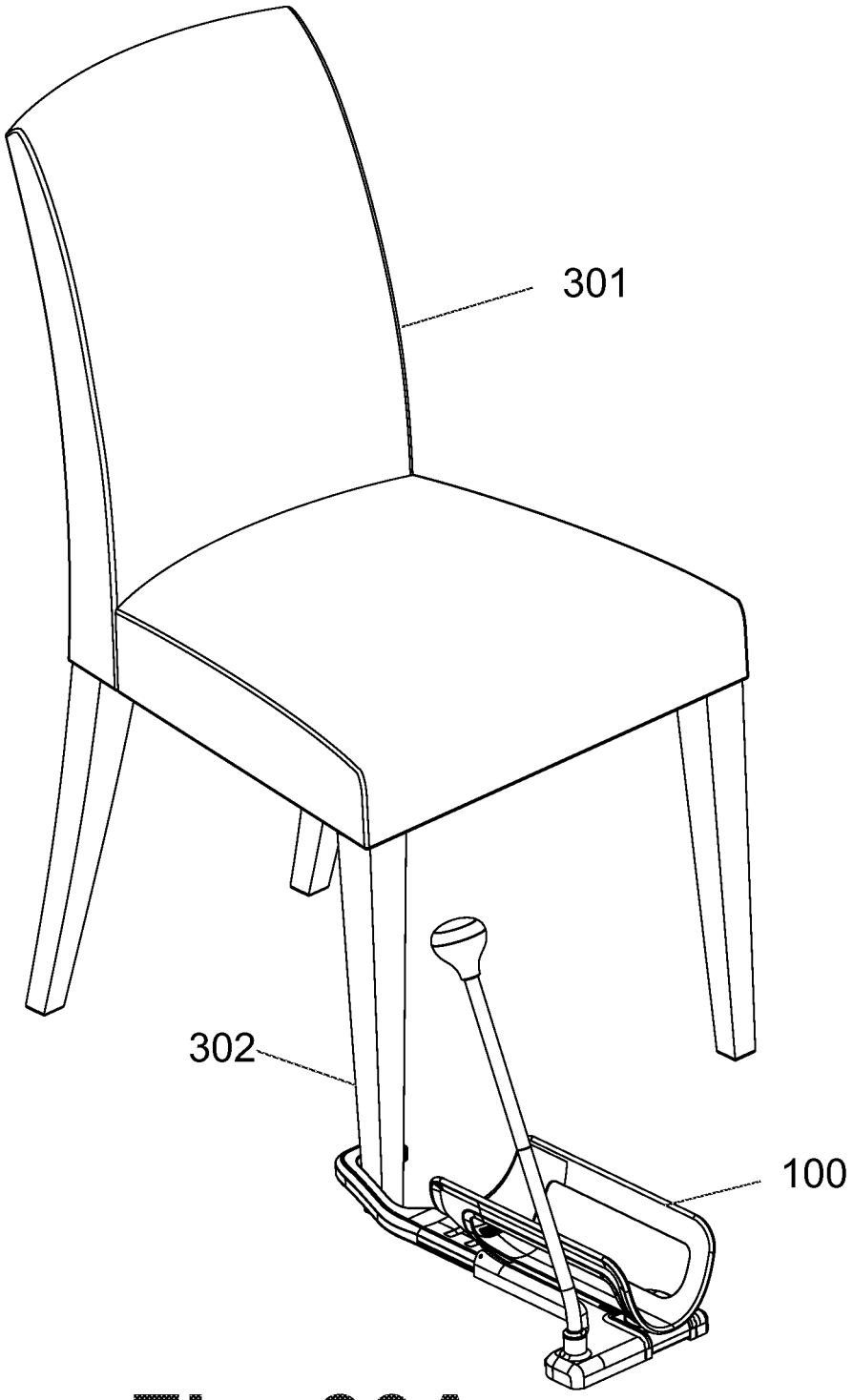
FIGS. 30A and 30B are schematic illustrations of the sock donning apparatus having its hook element engaging with a leg of a chair, in accordance with some demonstrative embodiments of the present invention.
Figure 30B:
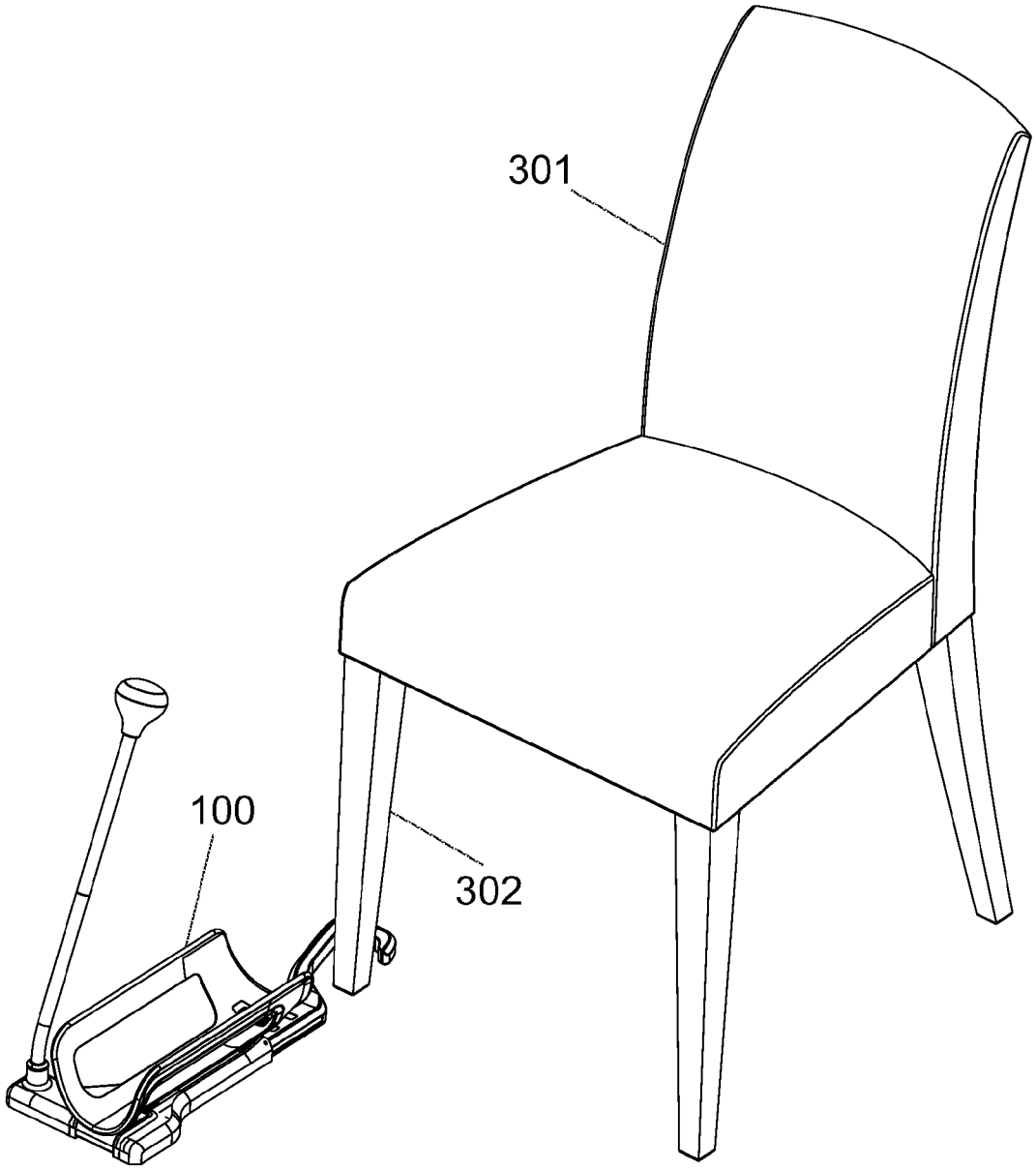

Reference is made to FIGS. 30A and 30B, which demonstrate the apparatus 100 having its hook element (or anchor element) partially-surrounding or partially-encircling (or engaging with) a leg 302 of a chair 301. Other suitable furniture articles, or other generally-stationary objects, may be used together with the apparatus 100.

The device may comprise a handle, or an elongated handle or shaft, thereby allowing the user to autonomously operate the device without requiring the user to bend his back or body, or without requiring the user to apply force on its back or its spinal cord or spine; and this may be advantageous to a user who is, for example, sick or ill or disabled or tired. The handle or shaft of the device may optionally be (or may comprise), for example, a folding handle, a dis-assembling handle, one or more components able to fold or dis-assemble, or other mechanism allowing the device to have a reduced form-factor in order to facilitate storage of the device and/or transport of the device.

The device may comprise an axis or hinge or gimbal, or a set of axes or hinges or gimballing elements, which may allow at least two degrees of freedom, or at least several degrees of freedom, or at least two gimballing directions or movement directions, thereby enabling the user to autonomously and easily perform the donning process (e.g., a first gimbal direction which may be generally parallel to the ground surface; and a second gimbal direction which may be slanted upwardly relative to the ground surface).

Figure 31A:
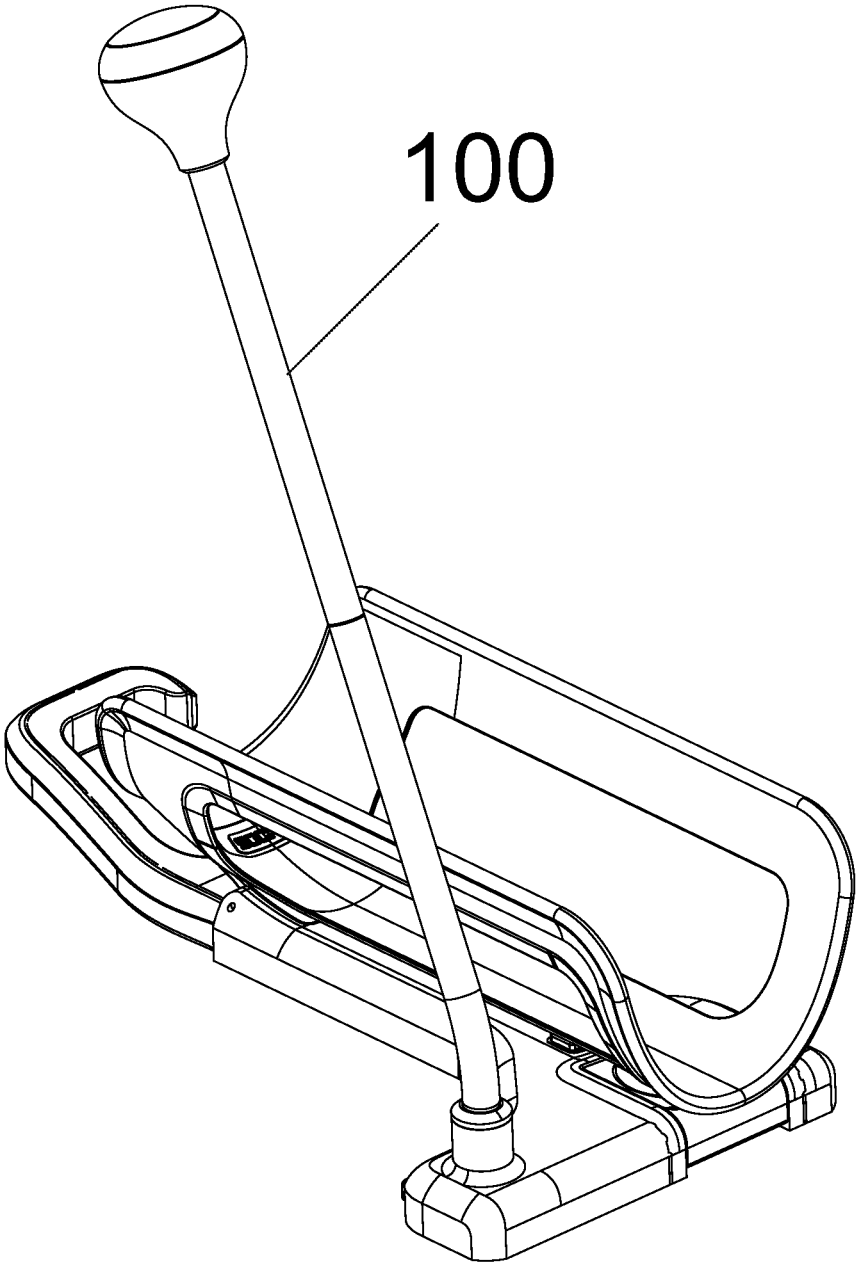
FIGS. 31A, 31B and 31C are schematic illustrations of the sock donning apparatus in three positions, demonstrating two different gimballing directions of the caddy of the apparatus, in accordance with some demonstrative embodiments of the present invention.
Figure 31B:
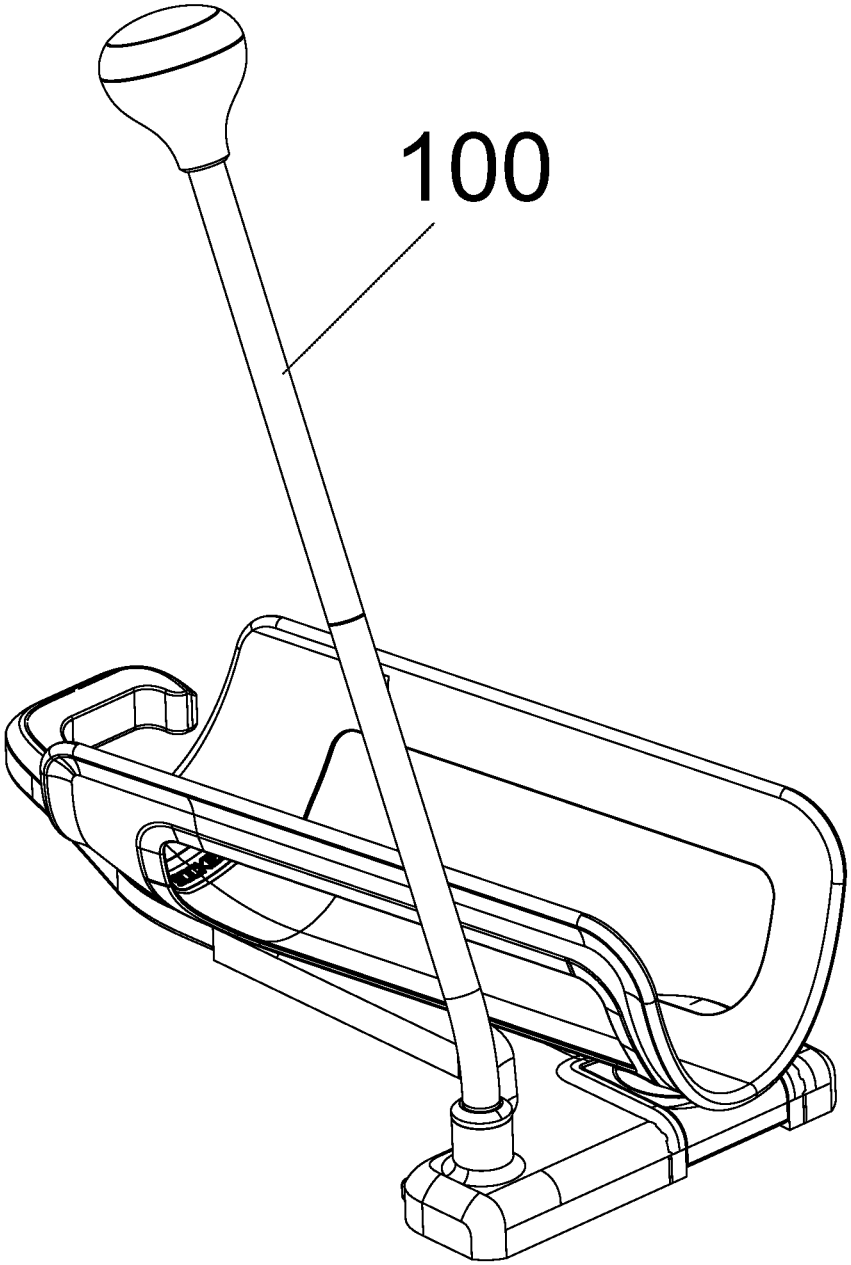
Figure 31C:
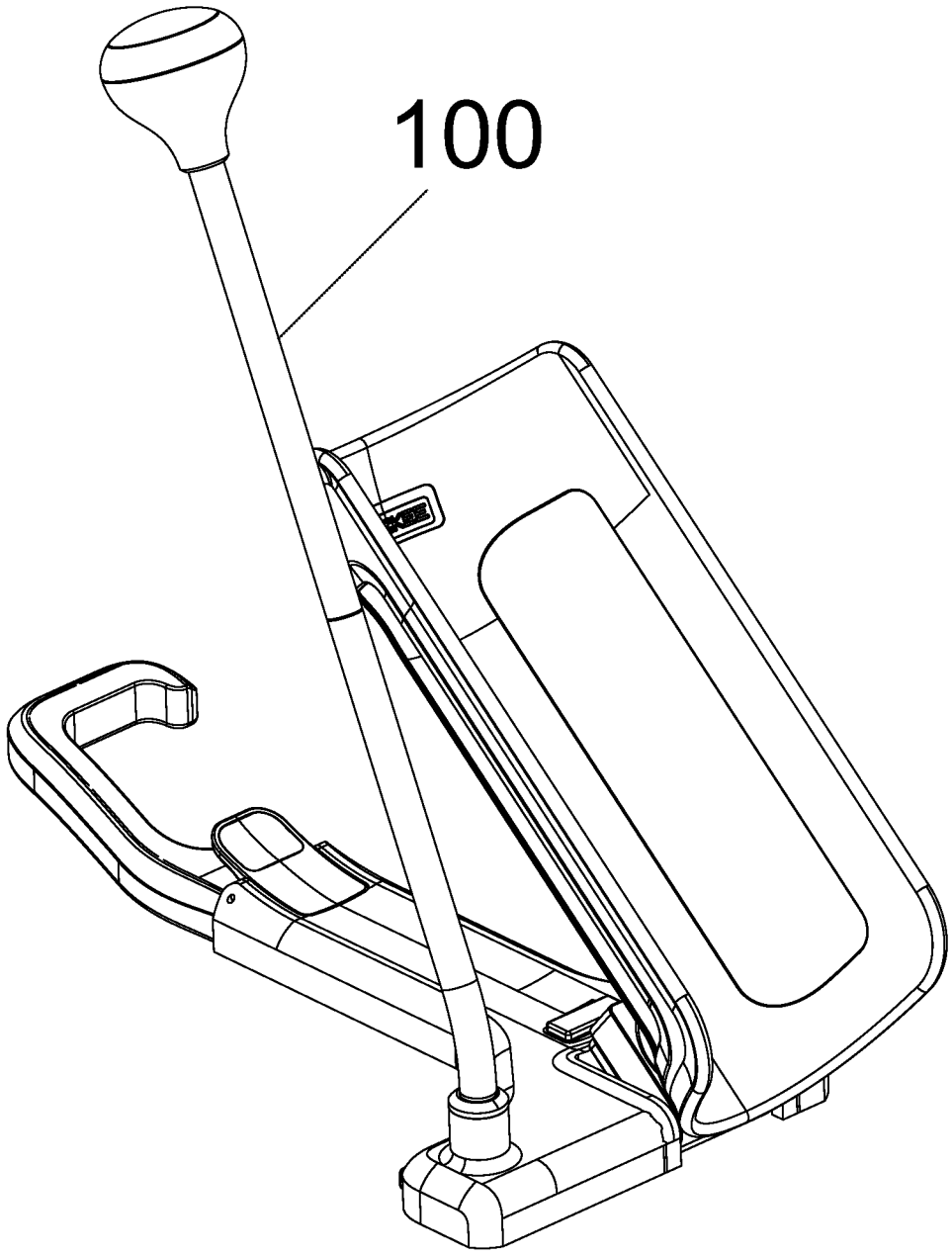

Reference is made to FIGS. 31A, 31B and 31C, which demonstrate the apparatus 100 in three positions or three states. For example, FIG. 31A demonstrates a rest position of apparatus 100; whereas FIG. 31B demonstrates gimballing along a first gimbal direction (e.g., generally parallel to the ground surface); and whereas FIG. 31C demonstrates gimballing along a second, different, gimbal direction (e.g., generally slanted relative to the ground surface). In some embodiments, the gimballing elements or the gimbals of apparatus 100 may allow simultaneous movement or concurrent movement of the caddy (or other element(s) of apparatus 100) in both of the gimbal directions, at the same time.

Some embodiments of the present invention may include an apparatus (or device) for donning socks, the apparatus comprising: a substantially horizontal base; an elongated U-shaped, semi-cylindrical caddy on which a sock positioned inside out is fittable and into an interior of which a foot is insertable; and a tilt unit coupled to said caddy and pivotally connected to a head portion of said base.

In some embodiments, the base is T-shaped and is configurable by an elongated main portion and two spaced, forwardly positioned head portions; wherein the tilt unit is insertable within an interspace between said two head portions; wherein the tilt unit is pivotally connected to said two head portions by at least one coupled horizontally disposed pin which is substantially perpendicular to said main portion; wherein the pin is introducible within a recess formed within a forwardly positioned projection of the tilt unit; wherein the tilt unit and the caddy are able to be tilted about a horizontal axis during a sock donning operation.

In some embodiments, the tilt unit has a central through-hole through which a part protruding from the caddy and connected with a projection of a flange passes; wherein said through-hole is positioned rearwardly from the projection of the tilt unit, allowing the caddy and flange to be rotated in unison about a vertical axis during the sock donning operation.

In some embodiments, the flange comprises a flange that limits the rotational displacement of the caddy about a central axis of the through hole.

In some embodiments, an inner face of each of the two head portions has (a) an upper, substantially straight and un-recessed region, and (b) a lower region which is angularly recessed with respect to said upper region, thereby allowing the flange to rotate for a predetermined angular distance when the caddy is at a rest position until the flange contacts said inner face, yet preventing the flange from rotating when the caddy is tilted.

In some embodiments, the apparatus further comprises: a hook member that is engageable with a relatively stationary element for providing a reactive force during the sock donning operation. In some embodiments, the elongated main portion of the base is hollowed to fixedly receive the hook member. In some embodiments, the hook member is selectively extendable with respect to the elongated main portion of the base. In some embodiments, the hook member comprises: an elongated positioning bar formed with a plurality of longitudinally spaced latching grooves; a hook rearwardly extending from said positioning bar; and a spring biased detent pivotally connected to the main portion of the base for selectively engaging one of said grooves. In some embodiments, the detent comprises: a finger contactable portion for disengaging the detent from the engaged groove, to allow the bar to be repositioned.

In some embodiments, the apparatus further comprises: a pole assembly extending upwardly from one of the head portions, for facilitating manual displacement of the apparatus. In some embodiments, the pole assembly comprises: a straight pole section, and a bent pole section that is movable within a cup attachment fixed to the base, for facilitating apparatus repositioning.

In some embodiments, a method or process for donning a sock (or multiple socks) may comprise: (a) providing an apparatus comprising a substantially horizontal base and an elongated U-shaped, semi-cylindrical caddy movably coupled to said base; (b) fitting a sock in an inside out arrangement over a rearward terminal edge of said caddy; (c) securing said base to a relatively stationary element for providing a reactive force during a sock donning operation while a user is positioned to the rear of said caddy; (d) inserting a foot of the user into the interior of the sock, while said foot applies a moment to said caddy to cause said caddy to pivot and an open end of the sock is gradually slipped off said rearward terminal edge of said caddy; and (e) fully inserting toes of the user into a toe portion of the sock, to cause said caddy to assume a final pivoted position and the sock to be released from said caddy.

In some embodiments, the caddy also rotates about a substantially vertical axis while the foot is being inserted into the interior of the sock.

In some embodiments, a first sock donning apparatus and a second sock donning apparatus are positioned forwardly to right and left feet, respectively, and first and second socks are donned on the right and left feet, respectively, thereby. In some embodiments, the first and second socks may be donned substantially simultaneously or concurrently or in parallel to each other.

In some embodiments, the method further comprises: providing a hook member coupled to the base; and affixing said hook member to the relatively stationary element. In some embodiments, the hook member is extendable; wherein the length of the hook member is set prior to inserting the foot into the interior of the sock.

In some embodiments, the method further comprises: utilizing a pole assembly, which extends upwardly from the base, to adjust a direction of the caddy relative to a direction of the foot to be inserted into the interior of the sock. In some embodiments, the pole assembly comprises: a straight pole section; a hand graspable knob fitted from above to said straight pole section; and a bent pole section fitted from below to said straight pole section that is rotatable within a cup attachment fixed to the base; wherein the method further comprises: selectively rotating said bent pole section when desired to bring said knob closer or farther away from the relatively stationary element in order to facilitate apparatus repositioning.

Functions, operations, components and/or features described herein with reference to one or more embodiments of the present invention, may be combined with, or may be utilized in combination with, one or more other functions, operations, components and/or features described herein with reference to one or more other embodiments of the present invention.

While certain features of the present invention have been illustrated and described herein, many modifications, substitutions, changes, and equivalents may occur to those skilled in the art. Accordingly, the claims are intended to cover all such modifications, substitutions, changes, and equivalents.

What is claimed is:

1. An apparatus for donning socks, comprising:

a substantially horizontal base;

an elongated U-shaped, semi-cylindrical caddy on which a sock positioned inside out is fittable and into an interior of which a foot is insertable; and a tilt unit coupled to said caddy and pivotally connected to a head portion of said base;

wherein the base is T-shaped and is configurable by an elongated main portion and two spaced, forwardly positioned head portions;

wherein the tilt unit is insertable within an interspace between said two head portions;

wherein the tilt unit is pivotally connected to said two head portions by at least one coupled horizontally disposed pin which is substantially perpendicular to said main portion;

wherein the pin is introducible within a recess formed within a forwardly positioned projection of the tilt unit;

wherein the tilt unit and the caddy are able to be tilted about a horizontal axis during sock donning operation;

wherein the tilt unit has a central through-hole through which a part protruding from the caddy and connected with a projection of a flange passes;

wherein said through-hole is positioned rearwardly from the projection of the tilt unit, allowing the caddy and flange to be rotated in unison about a vertical axis during the sock donning operation.

2. The apparatus of claim 1, wherein the flange comprises a flange that limits the rotational displacement of the caddy about a central axis of the through-hole.

3. The apparatus of claim 2, wherein an inner face of each of the two head portions has (a) an upper, substantially straight and unreccesed region, and (b) a lower region which is angularly recessed with respect to said upper region, thereby allowing the flange to rotate for a predetermined angular distance when the caddy is at a rest position until the flange contacts said inner face, yet preventing the flange from rotating when the caddy is tilted.

4. The apparatus of claim 1, further comprising:

a pole assembly extending upwardly from one of the head portions, for facilitating manual displacement of the apparatus.

5. The apparatus of claim 4, wherein the pole assembly comprises:

a straight pole section, and a bent pole section that is movable within a cup attachment fixed to the base, for facilitating apparatus repositioning.

6. An apparatus for wearing socks, comprising:

a substantially horizontal base;

an elongated U-shaped, semi-cylindrical caddy on which a sock positioned inside out is fittable and into an interior of which a foot is insertable; and a tilt unit coupled to said caddy and pivotally connected to a head portion of said base;

wherein the base is T-shaped and is configurable by an elongated main portion and two spaced, forwardly positioned head portions;

wherein the tilt unit is insertable within an interspace between said two head portions;

wherein the tilt unit is pivotally connected to said two head portions by at least one coupled horizontally disposed pin which is substantially perpendicular to said main portion;

wherein the pin is introducible within a recess formed within a forwardly positioned projection of the tilt unit;

wherein the tilt unit and the caddy are able to be tilted about a horizontal axis during a sock donning operation;

wherein the apparatus further comprises a hook member that is engageable with a relatively stationary element for providing a reactive force during the sock donning operation;

wherein the elongated main portion of the base is hollowed to fixedly receive the hook member;

wherein the hook member is selectively extendable with respect to the elongated main portion of the base;

wherein the hook member comprises:

an elongated positioning bar formed with a plurality of longitudinally spaced latching grooves;

a hook rearwardly extending from said positioning bar; and a spring biased detent pivotally connected to the main portion of the base for selectively engaging one of said grooves.

7. The apparatus of claim 6, wherein the detent comprises:

a finger contactable portion for disengaging the detent from the engaged groove, to allow the bar to be repositioned.

* * * * *